US010781660B2

(12) United States Patent
Arsalan et al.

(10) Patent No.: US 10,781,660 B2
(45) **Date of Patent: *Sep. 22, 2020**

(54) THRU-TUBING RETRIEVABLE INTELLIGENT COMPLETION SYSTEM

(71) Applicant: Saudi Arabian Oil Company, Dhahran (SA)

(72) Inventors: Muhammad Arsalan, Dhahran (SA); Mohamed N. Noui-Mehidi, Dhahran (SA)

(*) Notice: Subject to any disclaimer, the term of this patent is extended or adjusted under 35 U.S.C. 154(b) by 3 days.

This patent is subject to a terminal disclaimer.

(21) Appl. No.: 16/597,990

(22) Filed: Oct. 10, 2019

(65) Prior Publication Data

US 2020/0040700 A1 Feb. 6, 2020

Related U.S. Application Data

(63) Continuation of application No. 15/823,858, filed on Nov. 28, 2017, now Pat. No. 10,570,696.
(Continued)

(51) Int. Cl.
*E21B 33/14* (2006.01)
*E21B 33/16* (2006.01)
(Continued)

(52) U.S. Cl.
CPC ..... *E21B 33/146* (2013.01); *E21B 17/006* (2013.01); *E21B 17/1078* (2013.01);
(Continued)

(58) Field of Classification Search
CPC .... E21B 17/006; E21B 17/1078; E21B 23/06; E21B 33/12; E21B 33/127;
(Continued)

(56) References Cited

U.S. PATENT DOCUMENTS 3,460,624 A 8/1969 Aitken et al.
4,936,139 A 6/1990 Zimmerman
(Continued)

FOREIGN PATENT DOCUMENTS

WO 2012012587 A2 1/2012

OTHER PUBLICATIONS

Bosworth, Steve et al.; "Key Issues in Multilateral Technology" Oilfield Review, Winter 1998; pp. 14-28.
(Continued)

*Primary Examiner* — Caroline N Butcher
(74) *Attorney, Agent, or Firm* — Bracewell LLP; Constance G. Rhebergen; Christopher L. Drymalla

(57) ABSTRACT

Systems and methods for thru-tubing completion including a sub-surface completion unit (SCU) system including a SCU wireless transceiver for communicating with a surface control system of a well by way of wireless communication with a down-hole wireless transceiver disposed in a wellbore of the well, one or more SCU anchoring seals having an un-deployed position (enabling the SCU to pass through production tubing disposed in the wellbore of the well) and a deployed position (to seal against a wall of the target zone of the open-hole portion of the wellbore to provide zonal isolation between adjacent regions in the wellbore) and one or more SCU centralizers having an un-deployed position (enabling the SCU to pass through the production tubing disposed in the wellbore of the well) and a deployed position (to position the SCU in the target zone of the open-hole portion of the wellbore).

18 Claims, 8 Drawing Sheets

Related U.S. Application Data

(60) Provisional application No. 62/430,395, filed on Dec. 6, 2016.

(51) Int. Cl.

| | |
|---|---|
| ***E21B 47/12*** | (2012.01) |
| ***E21B 33/127*** | (2006.01) |
| ***E21B 44/00*** | (2006.01) |
| ***E21B 33/13*** | (2006.01) |
| ***E21B 17/10*** | (2006.01) |
| ***E21B 23/06*** | (2006.01) |
| ***E21B 41/00*** | (2006.01) |
| ***E21B 43/12*** | (2006.01) |
| ***E21B 47/13*** | (2012.01) |
| ***E21B 34/06*** | (2006.01) |
| ***E21B 17/00*** | (2006.01) |
| ***E21B 33/12*** | (2006.01) |
| ***E21B 47/01*** | (2012.01) |
| ***E21B 47/06*** | (2012.01) |
| ***E21B 47/10*** | (2012.01) |

(52) U.S. Cl.

CPC ..... *E21B 23/06* (2013.01); *E21B 33/12* (2013.01); *E21B 33/127* (2013.01); *E21B 33/1277* (2013.01); *E21B 33/13* (2013.01); *E21B 33/16* (2013.01); *E21B 34/06* (2013.01); *E21B 41/0035* (2013.01); *E21B 41/0042* (2013.01); *E21B 41/0085* (2013.01); *E21B 43/12* (2013.01); *E21B 44/005* (2013.01); *E21B 47/01* (2013.01); *E21B 47/06* (2013.01); *E21B 47/10* (2013.01); *E21B 47/12* (2013.01); *E21B 47/13* (2020.05)

(58) Field of Classification Search

CPC .... E21B 33/1277; E21B 33/13; E21B 33/146; E21B 33/16; E21B 34/06; E21B 41/0035; E21B 41/0042; E21B 41/0085; E21B 43/12; E21B 44/005; E21B 47/01; E21B 47/06; E21B 47/10; E21B 47/12; E21B 47/122

See application file for complete search history.

(56) References Cited

U.S. PATENT DOCUMENTS

| | | | |
|---|---|---|---|
| 5,301,760 | A | 4/1994 | Graham |
| 5,361,840 | A | 11/1994 | Matthews |
| 5,477,923 | A | 12/1995 | Jordan, Jr. et al. |
| 5,520,248 | A | 5/1996 | Sisson et al. |
| 5,785,125 | A | 7/1998 | Royer |
| 5,831,156 | A | 11/1998 | Mullins |
| 5,959,547 | A | 9/1999 | Tubel et al. |
| 6,112,809 | A | 9/2000 | Angle |
| 6,138,764 | A | 10/2000 | Scarsdale et al. |
| 6,311,774 | B1 | 11/2001 | Brockman et al. |
| 6,766,862 | B2 | 7/2004 | Chatterji et al. |
| 6,953,094 | B2 | 10/2005 | Ross et al. |
| 7,150,318 | B2 | 12/2006 | Freeman |
| 7,607,478 | B2 | 10/2009 | Martinez et al. |
| 7,669,653 | B2 | 3/2010 | Craster et al. |
| 7,726,407 | B2 | 6/2010 | Wood et al. |
| 3,011,438 | A1 | 9/2011 | Edwards et al. |
| 8,167,032 | B2 | 5/2012 | Lumbye et al. |
| 8,179,278 | B2 | 5/2012 | Shakra et al. |
| 8,284,075 | B2 | 10/2012 | Fincher et al. |
| 8,474,535 | B2 | 7/2013 | Richards et al. |
| 8,576,090 | B2 | 11/2013 | Lerche et al. |
| 8,668,008 | B2 | 3/2014 | Rytlewski et al. |
| 8,803,392 | B2 | 8/2014 | Aronstam et al. |
| 8,941,278 | B2 | 1/2015 | Aronstam |
| 9,068,415 | B2 | 6/2015 | Fraser |
| 9,133,671 | B2 | 9/2015 | Kellner |
| 9,243,490 | B2 | 1/2016 | Ade-Fosudo |
| 9,249,646 | B2 | 2/2016 | Hannegan et al. |
| 9,359,841 | B2 | 6/2016 | Hall |
| 9,598,921 | B2 | 3/2017 | Heijnen et al. |
| 9,611,709 | B2 | 4/2017 | O'Malley |
| 9,617,814 | B2 | 4/2017 | Searls et al. |
| 2007/0107913 | A1 | 5/2007 | Arnold et al. |
| 2007/0181304 | A1 | 8/2007 | Rankin et al. |
| 2008/0169106 | A1 | 7/2008 | Hill et al. |
| 2010/0319928 | A1 | 12/2010 | Burrear et al. |
| 2011/0073328 | A1 | 3/2011 | Clemens et al. |
| 2011/0192596 | A1* | 8/2011 | Patel ..... E21B 17/028 166/250.11 |
| 2013/0176138 | A1 | 7/2013 | Aronstam |
| 2013/0206410 | A1 | 8/2013 | Guerrero |
| 2013/0249704 | A1 | 9/2013 | Aronstam |
| 2014/0053666 | A1 | 2/2014 | Aronstam et al. |
| 2015/0267501 | A1 | 9/2015 | Al-Gouhi |
| 2016/0047203 | A1 | 2/2016 | Webster et al. |
| 2016/0265305 | A1 | 9/2016 | Davies et al. |

OTHER PUBLICATIONS

Bybee, Karen. "Through-Tubing Completions Maximize Production." Journal of petroleum technology 58.02 (2006); pp. 57-58.

Co-Pending U.S. Appl. No. 15/823,858, filed Nov. 28, 2017.

Co-Pending U.S. Appl. No. 15/823,862, filed Nov. 28, 2017.

Co-Pending U.S. Appl. No. 15/823,866, filed Nov. 28, 2017.

Halliburton "SwellpackerTM Technology Enables Intelligent Completions for Enhanced Oil Recovery in Openhole and Multilateral Wells" RedTech Paper, Nov. 2007; pp. 1-6.

Hembling, Drew, et al.; "Aramco uses swell packers to enable smart open-hole, multilateral completions for EOR" Drilling Contractor, Sep./Oct. 2007; pp. 108-114.

International Search Report and Written Opinion for International Application PCT/US2017/064617; International Filing Date Dec. 5, 2017: dated Feb. 26, 2018 (pp. 1-12).

International Search Report and Written Opinion for International Application PCT/US2017/064620; International Filing Date Dec. 5, 2017: dated Feb. 1, 2018 (pp. 1-13).

International Search Report and Written Opinion for International Application PCT/US2017/064622; International Filing Date Dec. 5, 2017: dated Feb. 23, 2018 (pp. 1-14).

International Search Report and Written Opinion for International Application PCT/US2017/064628; International Filing Date Dec. 5, 2017: dated Feb. 1, 2018 (pp. 1-12).

Shafiq, Muhammad et al.; "Realising the full potential of intelligent completions" Oil Review Middle East Issue Six 2009, pp. 78-80.

Co-Pending U.S. Appl. No. 15/823,854, filed Nov. 28, 2017.

* cited by examiner

THRU-TUBING RETRIEVABLE INTELLIGENT COMPLETION SYSTEM

FIELD

Embodiments relate generally to well completion systems and more particularly to thru-tubing completion systems.

BACKGROUND

A well generally includes a wellbore (or "borehole") that is drilled into the earth to provide access to a geographic formation below the earth's surface (often referred to as "subsurface formation") to facilitate the extraction of natural resources, such as hydrocarbons and water, from the formation, to facilitate the injection of fluids into the formation, or to facilitate the evaluation and monitoring of the formation. In the petroleum industry, wells are often drilled to extract (or "produce") hydrocarbons, such as oil and gas, from subsurface formations. The term "oil well" is typically used to refer to a well designed to produce oil. In the case of an oil well, some natural gas is typically produced along with oil. A well producing both oil and natural gas is sometimes referred to as an "oil and gas well" or "oil well."

Developing an oil well typically includes a drilling stage, a completion stage, and a production stage. The drilling stage normally involves drilling a wellbore into a portion of a subsurface formation that is expected to contain a concentration of hydrocarbons that can be produced, often referred to as a "hydrocarbon reservoir" or "reservoir." The drilling process is usually facilitated by a surface system, including a drilling rig that sits at the earth's surface. The drilling rig can, for example, operate a drill bit to cut the wellbore, hoist, lower and turn drill pipe, tools and other devices in the wellbore (often referred to as "down-hole"), circulate drilling fluids in the wellbore, and generally control various down-hole operations. The completion stage normally involves making the well ready to produce hydrocarbons. In some instances, the completion stage includes installing casing, perforating the casing, installing production tubing, installing down-hole valves for regulating production flow, and pumping fluids into the well to fracture, clean or otherwise prepare the formation and well to produce hydrocarbons. The production stage involves producing hydrocarbons from the reservoir by way of the well. During the production stage, the drilling rig is usually and replaced with a collection of valves at the surface (often referred to as a "production tree"). The production tree is operated in coordination with down-hole valves to regulate pressure in the wellbore, to control production flow from the wellbore and to provide access to the wellbore in the event additional completion work (often referred to as a "workover") is needed. A pump jack or other mechanism can provide lift that assists in extracting hydrocarbons from the reservoir, especially when the pressure in the well is so low that the hydrocarbons do not flow freely to the surface. Flow from an outlet valve of the production tree is normally connected to a distribution network of midstream facilities, such as tanks, pipelines and transport vehicles that transport the production to downstream facilities, such as refineries and export terminals. In the event a completed well requires workover operations, such as repair of the wellbore or the removal and replacement of down-hole components, a workover rig may need to be installed for use in removing and installing tools, valves, and production tubing.

SUMMARY

Applicants have recognized that traditional well configurations can create complexities with regard various aspects of drilling, completion and production operations. For example, production tubing is normally installed after casing is installed to avoid additional time and costs that would otherwise be involved with workover operations that require removing and reinstalling production tubing. For example, in the case of a workover operation that requires casing of a portion of the wellbore, the workover may involve retrieving installed production tubing installed before a casing operation and, then, re-running the production tubing after the casing operation is complete. Accordingly, it is important for well operators to have thorough plan for completing a well, including completion plans, to avoid potential delays and costs. Unfortunately, wells often experience unpredictable issues, and even a well-designed well plan is susceptible to alterations that can increase time and cost expenditures to develop the well. For example, over time wells can develop flows of undesirable substances, such as water or gas, into the wellbore from the formation (often referred to as "breakthrough"). Breakthrough can result in the unwanted substances inhibiting or mixing with production fluids. For example, water and gas entering at one portion of the wellbore may mix with oil production from an adjacent portion of the wellbore. Breakthrough often occurs in uncased (or "open-holed") sections of the wellbore, as there is no substantial barrier to fluid flowing into the wellbore from the formation. Attempted solutions can involve lining the portion of the wellbore to prevent the unwanted substances from entering the wellbore. If a portion of a wellbore is badly damaged, that portion of the wellbore may need to abandoned. This can include sealing off the damaged portion of the wellbore and, if needed, drilling a new wellbore section, such as a lateral, that avoids or otherwise routes around the damaged portion of the wellbore.

Unfortunately, when unforeseen issues with a well occurs, such as breakthrough or other damage, a well operator may have to modify a well plan for the well. This can include engaging in costly workover operations in an attempt to resolve the issue. For example, if casing is required to line a portion of the wellbore to remedy a breakthrough issue, the well operator may need to remove already installed production tubing, valves and tools from the wellbore, perform the casing operation to repair the wellbore, and finally reinstall the production tubing valves and tools in the wellbore. This can increase costs by way of the cost to perform the workover operations, as well as revenue losses associated with the lost production over the timespan of the workover operation. Unfortunately, these types of issue can arise over time, and are even more common with older existing wells. Thus, it is important to provide workover solutions that can effectively resolve these types of issues with minimal impact on a well plan, in effect helping to reduce costs or delays that are traditionally associated with workover operations and improve the net profitability of the well.

Recognizing these and other shortcomings of existing systems, Applicants have developed novel systems and methods of operating a well using a thru-tubing completion system (TTCS) employing subsurface completion units (SCUs). In some embodiments, a TTCS includes one or more SCUs that are deployed down-hole, in a wellbore having a production tubing string in place. For example, a SCU may be delivered through the production tubing to a target zone of the wellbore in need of completion, such as an open-holed portion of the wellbore that is down-hole from a down-hole end of the production tubing and that is experiencing breakthrough. In some embodiments, a deployed SCU is operated to provide completion of an associated target zone of the wellbore. For example, seals and valves of a deployed SCU may be operated to provide providing zonal fluid isolation of annular regions of the wellbore located around the SCU, to control the flow of breakthrough fluids into a stream of production fluids flowing up the wellbore and the production tubing.

In some embodiments, a SCU includes a modular SCU formed of one or more SCU modules (SCUMs). For example, multiple SCUMs may be stacked in series, end-to-end, to form a relatively long SCU that can provide completion of a relatively long section of a wellbore. This can provide additional flexibility as a suitable numbers of SCUMs may be stacked together to provide a desired length of completion in a wellbore. In some embodiments, the SCUMs can be assembled at the surface or down-hole. This can further enhance the flexibility of the system by reducing the number of down-hole runs needed to install the SCUs, by providing flexibility in the physical size of the SCU to be run through the production tubing and the wellbore, and by providing flexibility to add or remove SCUMs at a later time, as the well evolves over time. The ability to run the SCUs through the production tubing can enable the SCUs to provide completion functions, such as lining a wellbore of a well to inhibit breakthrough, without having to remove and re-run the production tubing in the well during installation or retrieval of the SCUs.

Provided in some embodiments is a thru-tubing completion system including a SCU adapted to pass through production tubing disposed in a wellbore of a well, and to be disposed in a target zone of an open-holed portion of the wellbore and perform completion operations in the target zone. The SCU including the following: a SCU wireless transceiver; one or more SCU anchoring seals adapted to be positioned in an un-deployed position and a deployed position (the un-deployed position of the one or more SCU anchoring seals enabling the SCU to pass through the production tubing disposed in the wellbore of the well, and the deployed position of the one or more SCU anchoring seals providing a seal against a wall of the target zone of the open-holed portion of the wellbore to provide zonal isolation between regions in the wellbore); and one or more SCU centralizers adapted to be positioned in an un-deployed position and a deployed position (the un-deployed position of the one or more SCU centralizers enabling the SCU to pass through the production tubing disposed in the wellbore of the well, and the deployed position of the one or more SCU centralizers positioning the SCU in the target zone of the open-holed portion of the wellbore). The system further including a down-hole wireless transceiver adapted to be disposed at a down-hole end of the production tubing in the wellbore of the well, to be communicatively coupled to a surface control system of the well, to communicate wirelessly with the SCU wireless transceiver, and to provide for communication between the SCU wireless transceiver and the surface control system of the well.

In some embodiments, the un-deployed position of the one or more SCU anchoring seals includes the one or more SCU anchoring seals having an outer diameter that is less than an inner diameter of the production tubing, and the deployed position of the one or more SCU anchoring seals includes the one or more SCU anchoring seals having an outer diameter that is equal to or greater than an inner diameter of the wall of the target zone of the open-holed portion of the wellbore. In certain embodiments, the un-deployed position of the one or more SCU centralizers includes the one or more one or more SCU centralizers having an outer diameter that is less than an inner diameter of the production tubing, and the deployed position of the one or more one or more SCU centralizers includes the one or more one or more SCU centralizers having an outer diameter that is equal to or greater than an inner diameter of the wall of the target zone of the open-holed portion of the wellbore.

In some embodiments, at least one of the one or more anchoring seals is retrievable, and at least one of the anchoring seals that is retrievable is adapted to be removed from the target zone with a body of the SCU when the body of the SCU is removed from the target zone. In certain embodiments, at least one of the one or more anchoring seals is detachable, and at least one of the anchoring seals that is detachable is adapted to detach from a body of the SCU and remain in the target zone when the body of the SCU is removed from the target zone. In some embodiments, at least one of the anchoring seals that is detachable includes an interior passage having an internal diameter that is equal to or greater than an internal diameter of the production tubing. In certain embodiments, at least one of the one or more anchoring seals is non-retrievable, and at least one of the anchoring seals that is non-retrievable is adapted to be inflated with a hardening substance and to detach from a body of the SCU and remain in the target zone when the body of the SCU is removed from the target zone. In some embodiments, at least one of the anchoring seals that is non-retrievable includes an interior passage having an internal diameter that is equal to or greater than an internal diameter of the production tubing. In certain embodiments, the deployed position of the one or more SCU anchoring seals is adapted to isolate a region of the target zone including a breakthrough of fluid to inhibit the fluid of the breakthrough from flowing into the wellbore.

In some embodiments, the SCU includes a plurality of SCUMs assembled to one another. In certain embodiments, the plurality of SCUMs are adapted to be assembled to one another prior to the SCU being passed through the production tubing to form the SCU prior to the SCU being passed through the production tubing. In some embodiments, the plurality of SCUMs are adapted to be advanced through the production tubing unassembled, and to be assembled to one another in the open-holed portion of the wellbore to form the SCU down-hole after the SCUMs are passed through the production tubing. In certain embodiments, the SCU wireless transceiver is configured to, in response to establishing commutation with the surface control system of the well, communicate directly with the surface control system of the well. In some embodiments, the system further includes a positioning device adapted to provide a motive force to advance the SCU through the production tubing and the wellbore. In some embodiments, the system further includes the production tubing disposed in the wellbore and the surface control system of the well.

Provided in some embodiments is a thru-tubing completion system including the following: a surface control system; production tubing disposed in a wellbore of a well; and a SCU adapted to pass through the production tubing and to be disposed in a target zone of an open-holed portion of the wellbore and perform completion operations in the target zone. The SCU including a SCU wireless transceiver, one or more SCU anchoring seals adapted to be positioned in an un-deployed position and a deployed position (the un-deployed position of the one or more SCU anchoring seals enabling the SCU to pass through the production tubing disposed in the wellbore of the well, and the deployed position of the one or more SCU anchoring seals providing a seal against a wall of the target zone of the open-holed portion of the wellbore to provide zonal isolation between regions in the wellbore), and one or more SCU centralizers adapted to be positioned in an un-deployed position and a deployed position (the un-deployed position of the one or more SCU centralizers enabling the SCU to pass through the production tubing disposed in the wellbore of the well, and the deployed position of the one or more SCU centralizers positioning the SCU in the target zone of the open-holed portion of the wellbore). The system further including the following: a down-hole wireless transceiver adapted to be disposed at a down-hole end of the production tubing in the wellbore of the well, to be communicatively coupled to the surface control system of the well, to communicate wirelessly with the SCU wireless transceiver, and to provide for communication between the SCU wireless transceiver and the surface control system of the well; and a positioning device adapted to provide a motive force to advance the SCU through the production tubing and the wellbore.

Provided in some embodiments is a method of completing a target zone of a wellbore of a well, the method including the following: passing a SCU through production tubing disposed in a wellbore of a well; passing the SCU though the wellbore of the well to a target zone of an open-holed portion of the wellbore; deploying one or more SCU centralizers of the SCU to position the SCU in the target zone of the open-hole portion of the wellbore; and deploying one or more SCU anchoring seals of the SCU to seal against a wall of the target zone of the open-hole portion of the wellbore to provide zonal isolation between regions in the wellbore.

In certain embodiments, passing the SCU through the production tubing includes passing the SCU through the production tubing in an un-deployed configuration including the one or more SCU centralizers and the one or more SCU anchoring seals in an un-deployed state having an outer diameter that is less than an inner diameter of the production tubing. In some embodiments, the SCU includes a plurality of SCUMs assembled to one another, and the method further includes assembling the plurality of SCUMs to one another to form the SCU prior to the SCU being passed through the production tubing. In certain embodiments, the SCU includes a plurality SCUMs assembled to one another, and the method further includes passing the plurality of SCUMs through the production tubing unassembled to one another, and assembling the plurality of SCUMs to one another in the open-holed portion of the wellbore to form the SCU down-hole after the SCUMs are passed through the production tubing. In some embodiments, the SCU includes a SCU wireless transceiver adapted to communicate with a surface control system of the well by way of wireless communication with a down-hole wireless transceiver, and the method further includes providing the down-hole wireless transceiver at a down-hole end of the production tubing in the wellbore of the well (the down-hole wireless transceiver being communicatively coupled to a surface control system of the well, and adapted communicate wirelessly with the SCU wireless transceiver, and to provide for communication between the SCU wireless transceiver and the surface control system of the well). In certain embodiments, the method includes, in response to the SCU wireless transceiver establishing communication with the surface control system of the well, the SCU wireless transceiver communicating directly with the surface control system of the well.

Figure 1:
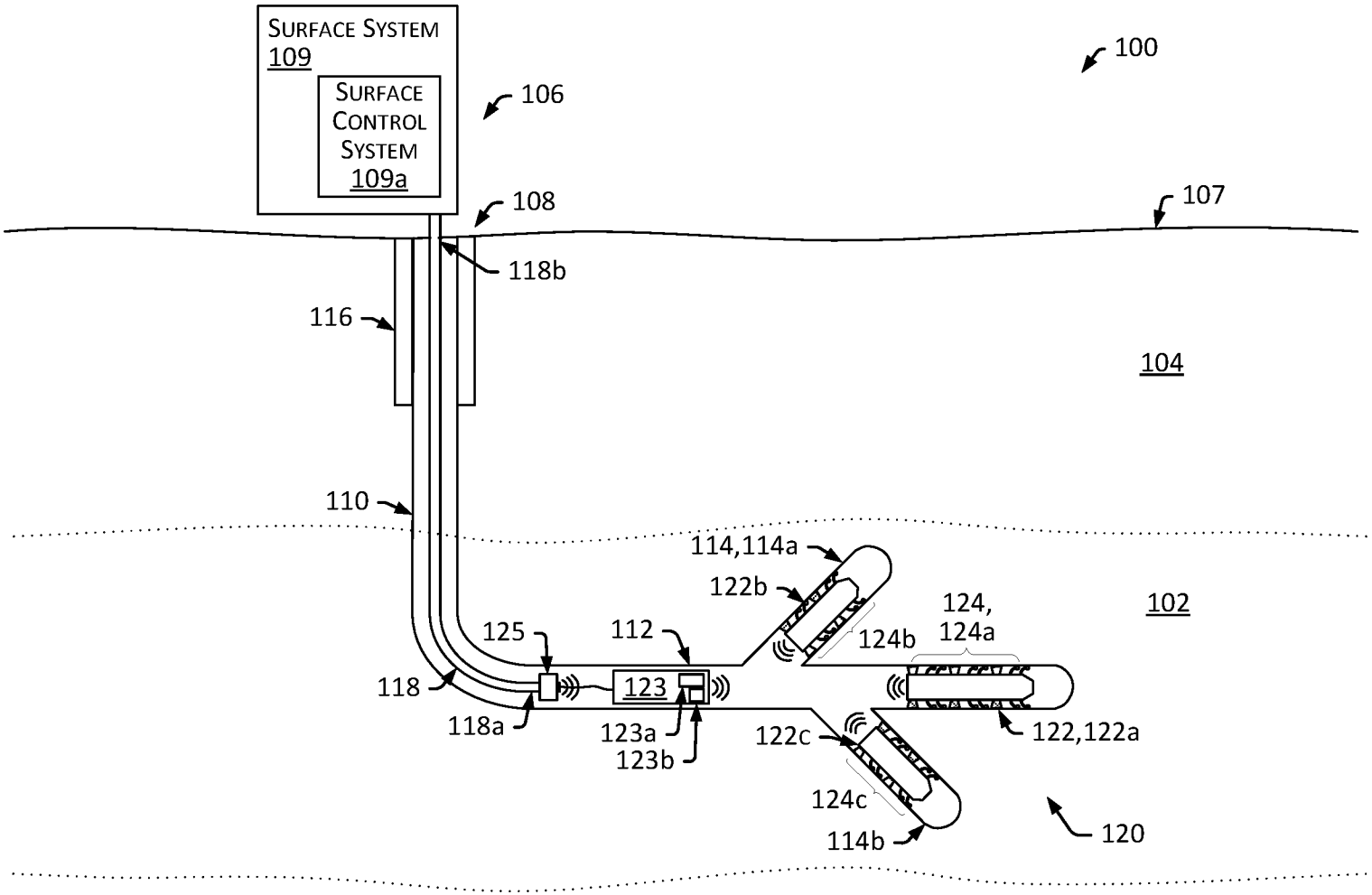
FIG. 1 is a diagram that illustrates a well environment in accordance with one or more embodiments.

While this disclosure is susceptible to various modifications and alternative forms, specific embodiments are shown by way of example in the drawings and will be described in detail. The drawings may not be to scale. It should be understood that the drawings and the detailed descriptions are not intended to limit the disclosure to the particular form disclosed, but are intended to disclose modifications, equivalents, and alternatives falling within the spirit and scope of the present disclosure as defined by the claims.

DETAILED DESCRIPTION

Described are embodiments of systems and methods of operating a well using a thru-tubing completion system (TTCS) employing subsurface completion units (SCUs). In some embodiments, a TTCS includes one or more SCUs that are deployed down-hole, in a wellbore having a production tubing string in place. For example, a SCU may be delivered through the production tubing to a target zone of the wellbore in need of completion, such as an open-holed portion of the wellbore that is down-hole from a down-hole end of the production tubing and that is experiencing breakthrough. In some embodiments, a deployed SCU is operated to provide completion of an associated target zone of the wellbore. For example, seals and valves of a deployed SCU may be operated to provide providing zonal fluid isolation of annular regions of the wellbore located around the SCU, to control the flow of breakthrough fluids into a stream of production fluids flowing up the wellbore and the production tubing.

In some embodiments, a SCU includes a modular SCU formed of one or more SCU modules (SCUMs). For example, multiple SCUMs may be stacked in series, end-to-end, to form a relatively long SCU that can provide completion of a relatively long section of a wellbore. This can provide additional flexibility as a suitable numbers of SCUMs may be stacked together to provide a desired length of completion in a wellbore. In some embodiments, the SCUMs can be assembled at the surface or down-hole. This can further enhance the flexibility of the system by reducing the number of down-hole runs needed to install the SCUs, by providing flexibility in the physical size of the SCU to be run through the production tubing and the wellbore, and by providing flexibility to add or remove SCUMs at a later time, as the well evolves over time. The ability to run the SCUs through the production tubing can enable the SCUs to provide completion functions, such as lining a wellbore of a well to inhibit breakthrough, without having to remove and re-run the production tubing in the well during installation or retrieval of the SCUs.

FIG. 1 is a diagram that illustrates a well environment 100 in accordance with one or more embodiments. In the illustrated embodiment, the well environment 100 includes a hydrocarbon reservoir (or "reservoir") 102 located in a subsurface formation (a "formation") 104, and a hydrocarbon well system (or "well system") 106.

The formation 104 may include a porous or fractured rock formation that resides underground, beneath the earth's surface (or "surface") 107. In the case of the well system 106 being a hydrocarbon well, the reservoir 102 may include a portion of the formation 104 that contains (or that is determined to or expected to contain) a subsurface pool of hydrocarbons, such as oil and gas. The formation 104 and the reservoir 102 may each include different layers of rock having varying characteristics, such as varying degrees of permeability, porosity, and resistivity. In the case of the well system 106 being operated as a production well, the well system 106 may facilitate the extraction of hydrocarbons (or "production") from the reservoir 102. In the case of the well system 106 being operated as an injection well, the well system 106 may facilitate the injection of fluids, such as water, into the reservoir 102. In the case of the well 106 being operated as a monitoring well, the well system 106 may facilitate the monitoring of characteristics of the reservoir 102, such reservoir pressure or water encroachment.

The well system 106 may include a hydrocarbon well (or "well") 108 and a surface system 109. The surface system 109 may include components for developing and operating the well 108, such as a surface control system 109*a*, a drilling rig, a production tree, and a workover rig. The surface control system 109*a* may provide for controlling and monitoring various well operations, such as well drilling operations, well completion operations, well production operations, and well and formation monitoring operations. In some embodiments, the surface control system 109*a* may control surface operations and down-hole operations. These operations may include operations of a subsurface positioning device 123 and SCUs 122 described here. For example, the surface control system 109*a* may issue commands to the subsurface positioning device 123 or the SCUs 122 to control operation of the respective devices, including the various operations described here. In some embodiments, the surface control system 109*a* includes a computer system that is the same as or similar to that of computer system 1000 described with regard to at least FIG. 8.

The well 108 may include a wellbore 110 that extends from the surface 107 into the formation 104 and the reservoir 102. The wellbore 110 may include, for example, a mother-bore 112 and one or more lateral bores 114 (for example, lateral bores 114*a* and 114*b*). The well 108 may include completion elements, such as casing 116 and production tubing 118. The casing 116 may include, for example, tubular sections of steel pipe lining an inside diameter of the wellbore 110 to provide structural integrity to the wellbore 110. The casing 116 may include filling material, such as cement, disposed between the outside surface of the steel pipe and the walls of the wellbore 110, to further enhance the structural integrity of the wellbore 110. The portions of the wellbore 110 having casing 116 installed may be referred to as a "cased" portions of the wellbore 110; the portions of the wellbore 110 not having casing 116 installed may be referred to as a "open-holed" or "un-cased" portions of the wellbore 110. For example, the upper portion of the illustrated wellbore 110 having casing 116 installed may be referred to as the cased portion of the wellbore 110, and the lower portion of the wellbore 110 below (or "down-hole" from) the lower end of the casing 116 may be referred to as the un-cased (or open-holed) portion of the wellbore 110.

The production tubing 118 may include a tubular pipe that extends from the surface system 109 into the wellbore 110 and that provides a conduit for the flow of production fluids between the wellbore 110 and the surface 107. For example, production fluids in the wellbore 110 may enter the production tubing 118 at a down-hole end 118*a* of the production tubing 118, the production fluids may travel up a central passage in the production tubing 118 to a production tree coupled to an up-hole end 118*b* of the production tubing 118 at the surface 107, and the production tree may route the production fluids a production collection and distribution network. The production tubing 118 may be disposed in one or both of cased and uncased portions of the wellbore 110. The production tubing 118 may have an inner diameter (ID) that is of sufficient size to facilitate the flow of production fluids through the production tubing 118. The production tubing 118 may have an outer diameter (OD) that is less than an ID of the components it passes through, such as the casing 116 or open-holed portions of the wellbore 110, to facilitate its installation in the wellbore 110. For example, the open-holed portion of the wellbore 110 may have an ID of about 6 inches (about 15 centimeters (cm)) and the production tubing 118 may have an OD of about 5 inches (about 13 cm) and an ID of about 4 inches (about 10 cm). In some embodiments, a portion of the wellbore 110 below the down-hole end 118*a* of the production tubing 118 is open-holed. For example, in the illustrated embodiment, the portion of the wellbore 110 down-hole of the down-hole end 118*a* of the production tubing 118 includes an open-holed, horizontally oriented portion of the mother-bore 112 and the open-holed lateral-bores 114*a* and 114*b*.

In some embodiments, the well system 106 includes a thru-tubing completion system (TTCS) 120. The TTCS 120 may include one or more sub-surface completion units (SCUs) 122 Each of the sub-surface completion units 122 may be disposed in, and provide for completion of, a respective target zone 124 of the wellbore 110. For example, a first SCU 122*a* may be disposed in a first target zone 124*a* in the wellbore 110 to control an undesirable breakthrough of water at the first target zone 124*a*, a second SCU 122*b* may be disposed in a second target zone 124*b* in the wellbore 110 to control an undesirable breakthrough of gas at the second target zone 124*b*, and a third SCU 122*c* may be disposed at a third target zone 124*c* in the wellbore 110 to seal off the lateral 114*b* to control an undesirable breakthrough of water in the distal (or "down-hole") portion of the lateral 114*b* located down-hole of the target zone 124*c*. In some embodiments, the first, second or third SCU 122*a*, 122*b* or 122*c* may be the same or similar to SCUs described here, such as SCUs 122, 122', 122", 122'" and modular SCUs 170, 170', 170" and 170'".

In some embodiments, a SCU 122 is advanced to a target zone 124 by way of the production tubing 118. For example, referring to SCU 122*a*, the SCU 122*a* may be advanced through an internal passage of the production tubing 118 such that it exits the production tubing 118 and enters the open-holed portion of the wellbore 110 at the down-hole end 118*a* of the production tubing 118, and then be advanced through the open-holed portion of the wellbore 110 to the target zone 124*a*.

In some embodiments, a SCU 122 is advanced through the production tubing 118 in an un-deployed configuration. In an un-deployed configuration, one or more expandable elements of the SCU 122, such as centralizers and anchoring seals, are provided in a retracted (or "un-deployed") position. In an un-deployed configuration the overall size of the SCU 122 may be relatively small in comparison to an overall size of the SCU 122 in a deployed configuration (which may include the one or more expandable elements of the SCU 122 provided in an extended (or "deployed") position). The un-deployed configuration may enable the SCU 122 to pass through the internal passage of the production tubing 118, and a smallest cross-section of an intervening portion of the wellbore 110 between the down-hole end 118*a* of the production tubing 118 and the target zone 124. For example, where the production tubing 118 has an ID of about 4 inches (about 10 cm) and the intervening open-holed portion of the wellbore 110 between the down-hole end 118*a* of the production tubing 118 and the target zone 124*a* has a minimum cross-sectional diameter of about 5 inches (about 13 cm), the SCU 122*a* may have an OD of about 4 inches (about 10 cm) or less in its un-deployed configuration. This may enable the SCU 122*a* to pass freely from the surface 107 to the target zone 124*a* by way of the production tubing 118 and the intervening portion of the wellbore 110. As a further example, where the production tubing has an ID of about 4 inches (about 10 cm) and the intervening open-holed portion of the wellbore 110 between the down-hole end 118*a* of the production tubing 118 and the target zone 124*b* has a minimum cross-sectional diameter of about 3 inches (about 7.5 cm), the SCU 122*b* may have an OD of 3 inches (about 7.5 cm) or less in its un-deployed configuration. This may to enable the SCU 122*b* to pass freely from the surface 107 to the target zone 124*b* by way of the production tubing 118 and the intervening portion of the wellbore 110.

In a deployed configuration of a SCU 122, one or more expandable elements of the SCU 122, such as centralizers and anchoring seals, are provided in an extended (or "deployed") position to facilitate to provide completion operations, such as the SCU 122 sealing off at least a portion of a target zone 124. For example, a SCU 122 may have positioning devices, such as centralizers that are expanded radially outwardly into a deployed configuration to center the SCU 122 in the wellbore 110, and anchoring seals that are expanded radially outwardly to engage and seal against a wall of the wellbore 110 located about the SCU 122. A centralizer may include a member, such as an arm or hoop, that is extended radially to engage the wall of the wellbore 110 and bias a body of the SCU 122 away from the wall of the wellbore 110. This biasing may "center" the body of the SCU 122 in the wellbore 110. An anchoring seal may include a sealing member, such as a ring shaped inflatable bag disposed about the exterior of a body of a SCU 122, that is expanded radially to provide a fluid seal between an exterior of a body of the SCU 122 and the wall of the wellbore 110. This may provide fluid seal between regions on opposite sides of the sealing member, and in effect provide "zonal fluid isolation" between regions on opposite sides of the sealing member. In a deployment operation for a SCU 122, centralizers of the SCU 122 may be extended first, to bias a body of the SCU 122 away from the walls of the wellbore 110 and center the SCU 122, and anchoring seals of the SCU 122 may be expanded second to secure the SCU 122 within the wellbore 110 and to provide zonal fluid isolation of regions in the wellbore located on opposite sides of each of the anchoring seals.

In a deployed configuration, a lateral cross-sectional size of the SCU 122 (for example, an OD of the SCU 122) may be relatively large in comparison to a lateral cross-sectional size of the SCU 122 in an un-deployed configuration. An OD of the SCU 122 may be equal to or greater than cross-sectional size (for example, ID) of the target zone 124 of the wellbore 110. For example, the centralizers of the SCU 122 may have a fully expanded size that is greater than the size of the target zone 124 of the wellbore 110 in its deployed state to provide a biasing force to move a body of the SCU 122 away from the walls of the wellbore 110. As a further example, the anchoring seals of the SCU 122 may have a fully expanded size that is greater than the size of the target zone 124 of the wellbore 110 in its deployed state to provide sealing contact at the interface of the anchoring seal 128 and the wall of the wellbore 110. In some embodiments, a SCU 122 is maintained in an un-deployed configuration in which the SCU 122 has a relatively small size, while the SCU 122 is advanced from the surface 107 to a target zone 124 by way of the production tubing 118 and an intervening portion of the wellbore 110 between the down-hole end 118*a* of the production tubing and the target zone 124. Once the SCU 122 is positioned in the target zone 124, the SCU 122 may be deployed, including expanding its centralizers and anchoring seals, to provide completion operations, such as zonal fluid isolation of at least a portion of the target zone 124. Thus, a SCU 122 may have the flexibility to be passed through a relatively small production tubing 118 in a wellbore 110, and still provide completions operations in a portion of the wellbore 110 having a relatively large cross-sectional area.

In some embodiments, a SCU 122 is retrievable. For example, the SCU 122*a* may be delivered to and deployed in a target zone 124*a*, and later be retrieved from the target zone 124*a* when the SCU 122*a* is no longer needed in the target zone 124*a* or to provide for passage of other devices through the target zone 124*a*. In some embodiments, a retrievable SCU 122 can be repositioned within the wellbore 110. For example, the SCU 122*a* may be deployed in the target zone 124*a* to address a breakthrough at the target zone 124*a*, and after the breakthrough in the target zone 124*a* is resolved and a new breakthrough has occurred in the target zone 124*c*, the SCU 122*a* may be moved from the target zone 124*a* to the target zone 124*c* to address the breakthrough at target zone 124*c*.

In some embodiments, a SCU 122 communicates wirelessly with other components of the system, including the surface system 109. For example, the SCU 122 may include a SCU wireless transceiver that can communicate wirelessly with a down-hole wireless transceiver 125. The down-hole wireless transceiver 125 may function as an intermediary for relaying communications between the surface control system 109*a* and the SCU 122. The down-hole wireless transceiver 125 may be disposed, for example, at or near the down-hole end 118*a* of the production tubing 118. For example, the down-hole wireless transceiver 125 may be located within about 20 feet (about 6 meters) of the down-hole end 118*a* of the production tubing 118. The down-hole wireless transceiver 125 may be communicatively coupled to the surface control system 109*a*. For example, the wireless transceiver 125 may have a wired or wireless connection to the surface control system 109*a*. As a result, in some embodiments, the SCU 122 can be deployed in the wellbore 110, physically untethered from the production tubing 118 and the surface system 109, and the SCU 122 can operate as a standalone unit that communicates wirelessly with the surface control system 109*a* by way of the down-hole wireless transceiver 125.

In some embodiments, positioning of a SCU 122 is facilitated by a subsurface positioning device 123, such as a tractor. The subsurface positioning device 123 may be capable of navigating the interior passage of the production tubing 118 and the interior of the wellbore 110, and be capable of providing the motive force (for example, pushing or pulling) necessary to advance the SCU 122 through the production tubing 118 and the wellbore 110. For example, during an installation operation, the positioning device 123 may couple to a trailing end (or "up-hole") end of the SCU 122*a* while located at the surface 107, and push the SCU 122*a* down-hole, through the production tubing 118 and along the intervening open-holed portion of the wellbore 110, into position at the target zone 124*a*. During a retrieval operation, the positioning device 123 may couple to the up-hole end of the SCU 122*a* while it is positioned in the target zone 124*a*, and pull the SCU 122*a* up-hole from the target zone 124*a*, along the intervening open-holed portion of the wellbore 110 and through the production tubing 118, to the surface 107. During a repositioning operation, the positioning device 123 may couple to the up-hole end of the SCU 122*a* while it is located in the target zone 124*a*, pull the SCU 122*a* up-hole from the target zone 124*a*, along the open-holed portion of the wellbore 110, and push the SCU 122*a* to another target zone 124, such as the target zone 124*c*.

In some embodiments, the subsurface positioning device 123 may not be rigidly coupled to the surface system 109. For example, the subsurface positioning device 123 may include a down-hole tractor having a local propulsion system that provides the motive force necessary to propel the subsurface positioning device 123 and SCUs 122 through the production tubing 118 and the wellbore 110. The local propulsion system may include, for example, an onboard battery, an electrical motor driven by the battery, and wheels or tracks driven by the motor. In some embodiments, the subsurface positioning device 123 is tethered to the surface system 109. For example, the subsurface positioning device 123 may have a wired connection to the surface system 109 that provides for data communication between the positioning device 123 and the surface system 109, and the transfer of electrical power from the surface system 109 to the positioning device 123. In some embodiments, the subsurface positioning device 123 is not directly tethered to the surface system 109. For example, the subsurface positioning device 123 may have a wireless transceiver 123*a* that provides wireless communication with the surface system 109 or the down-hole wireless transceiver 125. In such an embodiment, the subsurface positioning device 123 may communicate wirelessly with the surface system 109 directly or by way of wireless communication between wireless transceiver 123*a* and the down-hole wireless transceiver 125. For example, in response to determining that wireless communication can be established directly between the wireless transceiver 123*a* and the surface system 109 (for example, the SCU 122 has sufficient power available and the surface system 109 is within communication range of the wireless transceiver 123*a*), the wireless transceiver 123*a* may communicate directly with the surface system 109 by way of wireless communication. In response to determining that wireless communication cannot be established directly between the wireless transceiver 123*a* and the surface system 109 (for example, the SCU 122 does not have sufficient power available or the surface system 109 is not within communication range of the wireless transceiver 123*a*), the wireless transceiver 123*a* may communicate indirectly with the surface system 109, by way of the down-hole wireless transceiver 125 (for example, the down-hole wireless transceiver 125 may relay communications between the wireless transceiver 123*a* and the surface system 109). In some embodiments, the wireless transceiver 123*a* may communicate indirectly with the surface system 109, by way of the down-hole wireless transceiver 125, regardless of whether wireless communication can be established directly between the wireless transceiver 123*a* and the surface system 109. The communication between the positioning device 123 and the surface system 109 may include, for example, commands from the surface system 109 to control operation of the positioning device 123, or reporting data from the positioning device 123, such as providing feedback on the status and operation of the positioning device 123 or down-hole environmental conditions.

In some embodiments, the subsurface positioning device 123 may communicate wirelessly with the SCUs 122. For example, in an instance in which wireless communications from the SCU 122*a* located in the target zone 124*a* is not able to reach the down-hole wireless transceiver 125, the positioning device 123 may be moved into a location between the down-hole wireless transceiver 125 and the target zone 124*a*, and the wireless positioning device 123 may relay communications between the down-hole wireless transceiver 125 and a wireless transceiver of the SCU 122*a* by way of the wireless transceiver 123*a*. In some embodiments, the subsurface positioning device 123 may include an inductive coupler 123*b* that enables the positioning device 123 to communicate with a complementary inductive coupler of a SCU 122. For example, if the down-hole end of the positioning device 123 includes a first inductive coupler 123*a*, the up-hole end of the SCU 122*a* includes a second inductive coupler, and the down-hole end of the positioning device 123 is coupled to the up-hole end of the SCU 122*a*, such that the first and second inductive couplers are inductively coupled and capable of transmitting communications, the positioning device 123 and the SCU 122*a* may communicate with one another by way of the first and second inductive couplers.

Figure 2A:
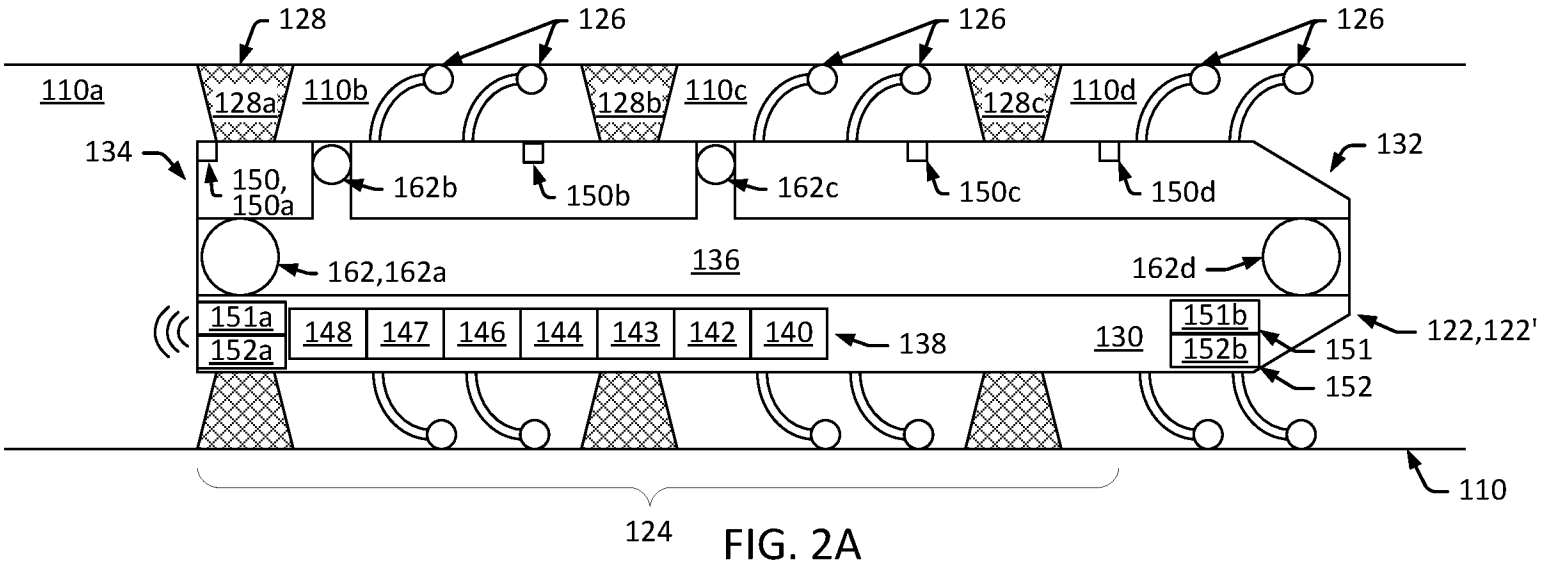
FIGS. 2A-4B are diagrams that illustrate sub-surface completion units (SCUs) in accordance with one or more embodiments.
Figure 2B:
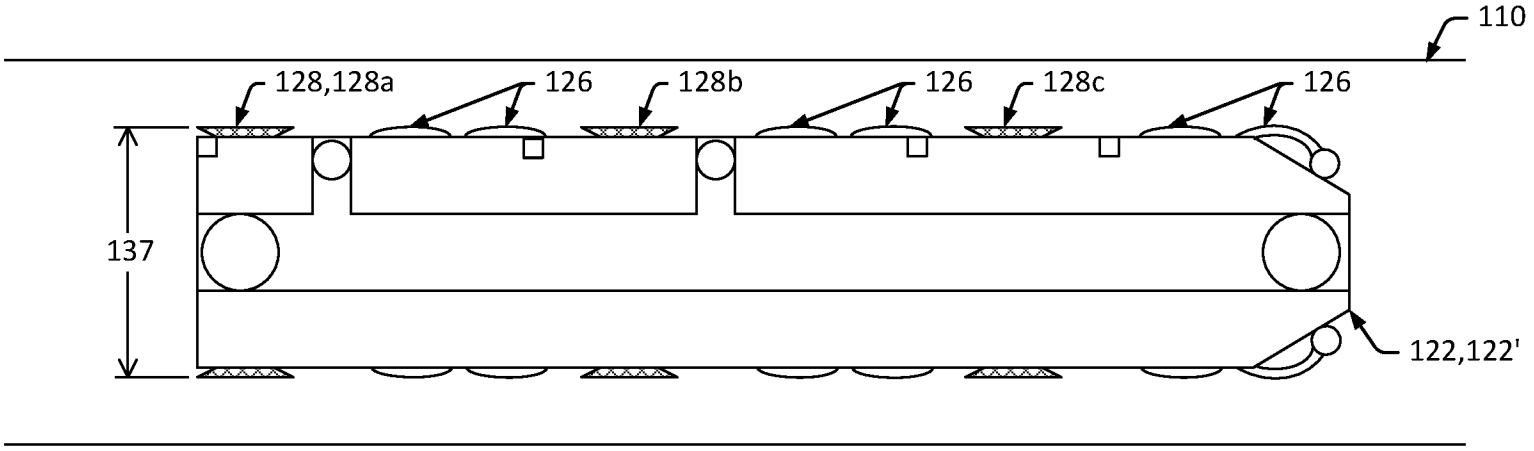
Figure 3A:
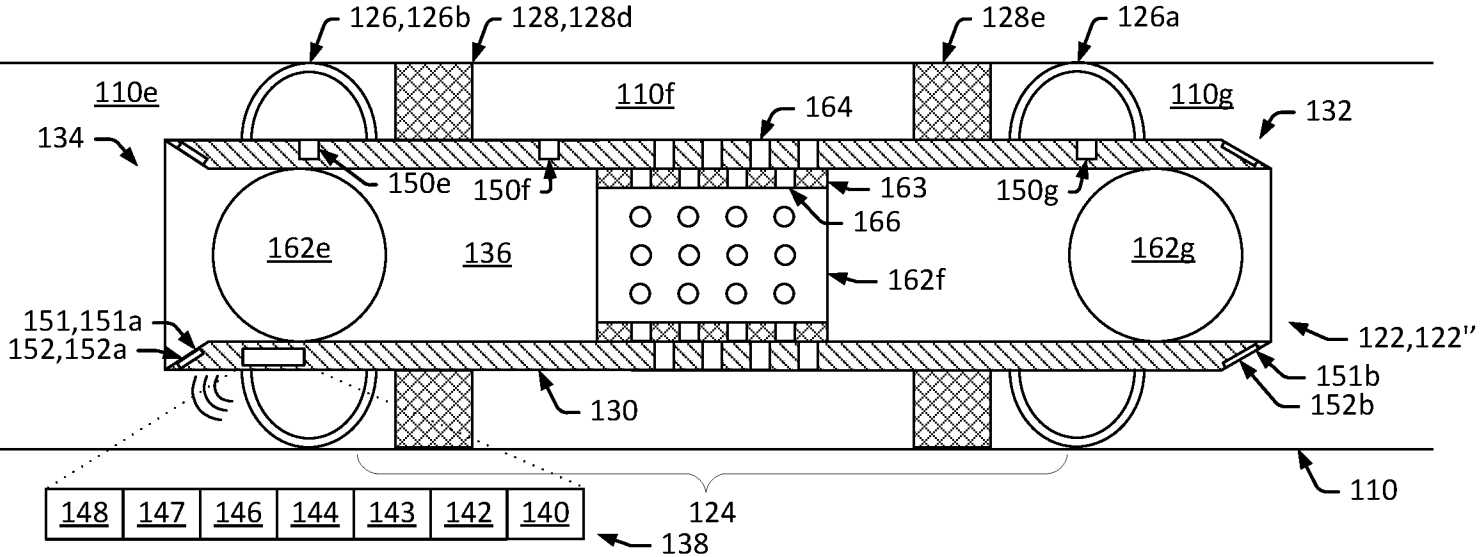
Figure 3B:
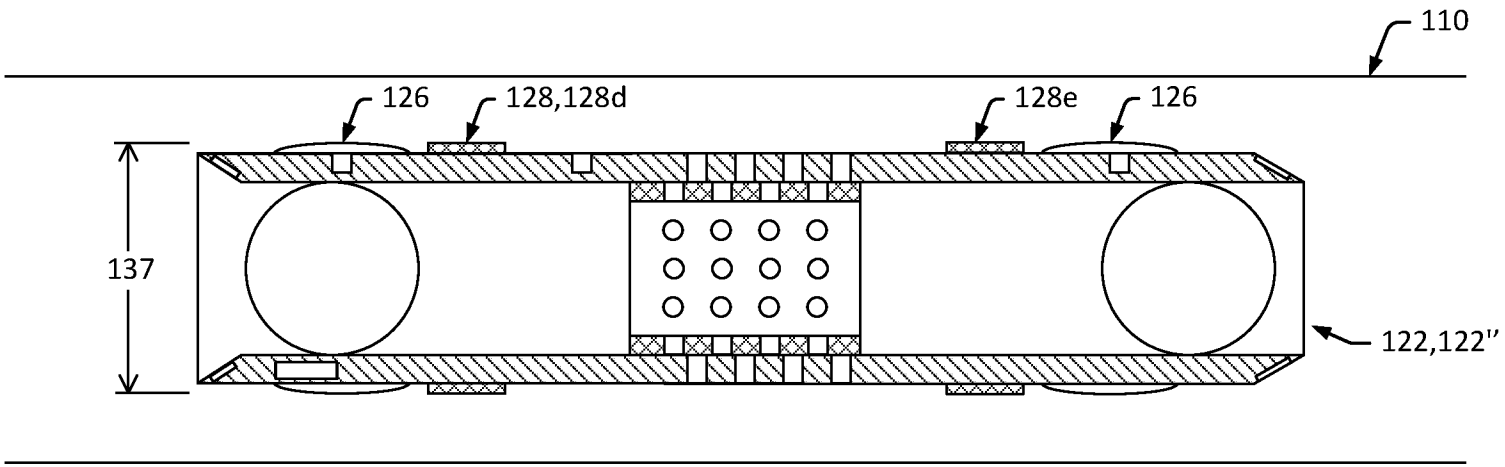
Figure 4A:
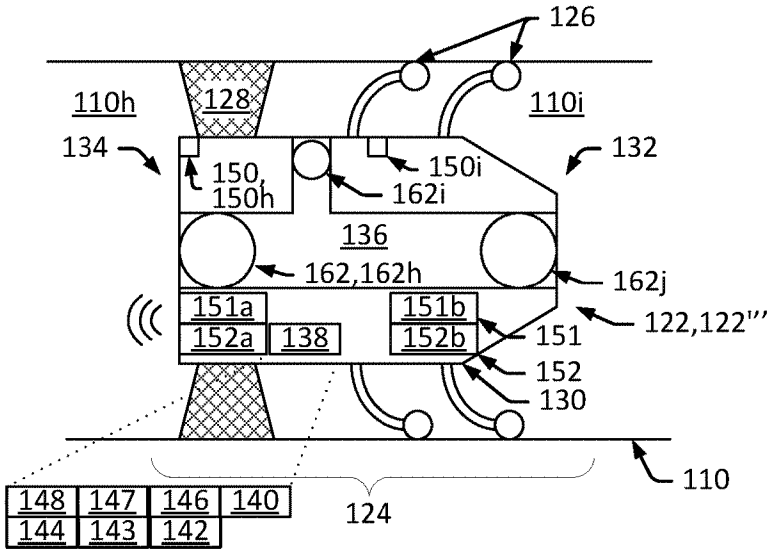
Figure 4B:
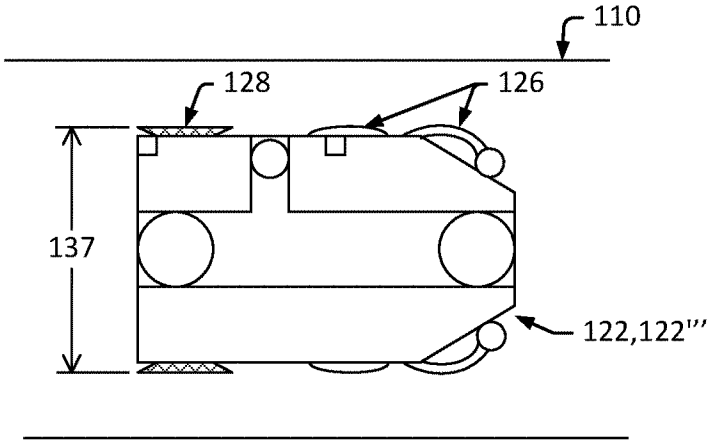

FIGS. 2A-4B are diagrams that illustrate longitudinally cross-sectioned views of example SCUs 122, including SCUs 122', 122" and 122'", in accordance with one or more embodiments. FIGS. 2A, 3A and 4A illustrate the example SCUs 122 in deployed configurations, and FIGS. 2B, 3B and 4B illustrate the example SCUs 122 in un-deployed configurations in accordance with one or more embodiments.

In some embodiments, a SCU 122 includes one or more positioning devices that provide positioning of the SCU 122 in the wellbore 110 or zonal fluid isolation of regions within of the wellbore 110. The positioning devices may include one or more centralizers 126 and one or more anchoring seals 128. A centralizer 126 of a SCU 122 may be deployed to bias a body of the SCU 122 away from the walls of the wellbore 110. This biasing may effectively "center" the SCU 122 within the wellbore 110. An anchoring seal 128 of a SCU 122 may be deployed to secure (or "anchor") the SCU 122 within the wellbore 110 and to provide a fluid seal between adjacent regions of the wellbore 110, referred to as zonal fluid isolation of the adjacent regions.

In some embodiments, a SCU 122 includes a body 130. The SCU 122 and the body 130 of the SCU 122 may be defined as having a first ("leading" or "down-hole") end 132 and a second ("trailing" or "up-hole") end 134. The down-hole end 132 of the SCU 122 and the body 130 may refer to an end of the SCU 122 and the body 130 to be advanced first into the wellbore 110, ahead of the opposite, up-hole end 134 of the SCU 122 and the body 130. When positioned in the wellbore 110, the down-hole end 132 of the SCU 122 and the body 130 may refer to an end of the SCU 122 and the SCU body 130 that is nearest to the down-hole end of the wellbore 110, and the up-hole end 134 of the SCU 122 and the body 130 may refer to an end of the SCU 122 and the SCU body 130 that is nearest to the surface 107 by way of the wellbore 110. In some embodiments, the body 130 includes a tubular member that defines a central passage 136. The central passage 136 may act as a conduit to direct fluid flow through the SCU 122, between a portion of the wellbore 110 located down-hole of the SCU 122 and a portion of the wellbore 110 located up-hole of the SCU 122. Referring to the SCU 122' of FIGS. 2A and 2B, the SCU 122" of FIGS. 3A and 3B and the SCU 122'" of FIGS. 4A and 4B, each of the SCUs 122', 122" and 122'" and the respective SCU bodies 130 include a down-hole end 132 and an up-hole end 134.

In some embodiments, a centralizer 126 of a SCU 122 includes one or more members that are extended radially outward, from a retracted (or "un-deployed") position to an expanded (or "deployed") position, to engage (for example, press against) the wall of the wellbore 110 and bias the body 130 of the SCU 122 away from the wall of the wellbore 110. This may "center" the body 130 of the SCU 122 in the wellbore 110. Centering of the body 130 may involve creating an annular region around the body 130, between the walls of the wellbore 110 and an exterior of the body 130. A centralizer 126 may be a flexible arm or hoop that is held in a retracted (un-deployed) position while the SCU 122 is moved through the production tubing 118 and the wellbore 110 into a target zone 124 of the wellbore 110, and that is expanded (deployed) while the SCU 122 is located in the target zone 124, to bias the body 130 of the SCU 122 away from the wall of the wellbore 110.

Referring to the example SCU 122' of FIGS. 2A and 2B, each of the centralizers 126 of the SCU 122' may include a respective set of arms disposed about an exterior of the body 130 of the SCU 122', at a respective longitudinal position along a length of the body 130 of the SCU 122'. Each of the centralizers 126 may, for example, be rotated from a retracted (un-deployed) position to an expanded (deployed) position to press against laterally adjacent portions of the wall of the wellbore 110 surrounding the body 130 of the SCU 122'. Referring to the example SCU 122" of FIGS. 3A and 3B, each of the centralizers 126 of the SCU 122" may include a respective set of elongated members disposed about an exterior of the body 130 of the SCU 122", at a respective longitudinal position along a length of the body 130 of the SCU 122". A first (or "down-hole") centralizer 126*a* may be located between anchoring seals 128 and the down-hole end 132 of the body 130, and a second (or "up-hole") centralizer 126*b* may be disposed between the anchoring seals 128 and the up-hole end 134 of the SCU body 130. Each of the centralizers 126 may include a set of hoop shaped members that extended from a retracted (un-deployed) position (in which the members are relatively flat) to an expanded (deployed) position (in which the members form a relatively curved, crescent shape) to press against laterally adjacent portions of the wall of the wellbore 110 surrounding the body 130 of the SCU 122". Referring to the example SCU 122'" of FIGS. 4A and 4B, each of the centralizers 126 of the SCU 122' may include a respective set of elongated members disposed about an exterior of the body 130 of the SCU 122'", at a respective longitudinal position along a length of the body 130 of the SCU 122'. Each of the centralizers 126 may, for example, be rotated from a retracted (un-deployed) position to an expanded (deployed) position to press against laterally adjacent portions of the wall of the wellbore 110 surrounding the body 130 of the SCU 122'".

In some embodiments, an anchoring seal 128 of a SCU 122 includes one or more sealing elements that are expanded radially outward, from a retracted (or "un-deployed") position to an expanded (or "deployed") position, to secure (or "anchor") the SCU 122 within the wellbore 110 and to seal-off adjacent regions of the wellbore 110. In some embodiments, an anchoring seal 128 is a ring shaped-element that extends laterally around the circumference of a body 130 of the SCU 122, and is expanded radially (deployed) to engage the portion of the wall of the wellbore 110 laterally adjacent the SCU body 132, and to form a fluid seal between the exterior of the SCU body 132 and the laterally adjacent portion of the wellbore 110. This may provide a fluid barrier or seal between regions on opposite sides of the anchoring seal 128, and in effect provide "zonal fluid isolation" between regions on opposite sides of the anchoring seal 128. For example, an anchoring seal 128 of a SCU 122 may be an inflatable ring (for example, a donut shaped bladder) positioned around a circumference of the SCU body 130. The anchoring seal 128 may remain in an uninflated (un-deployed) position while the SCU 122 is advanced to a target zone 124 of the wellbore 110 by way of the production tubing 118 and an intervening portion of the wellbore 110. The anchoring seal 128 may be inflated (deployed) to fill an annular region between the body 130 of the SCU 122 and the walls of the wellbore 110. The inflated anchoring seal 128 may engage (for example, seal against) the walls of the wellbore 110 in the target zone 124 to anchor the SCU 122 in the target zone 124, and to provide a fluid seal between an exterior of the body 130 and the walls of the wellbore 110. The resulting fluid seal may provide zonal fluid isolation between a region of the wellbore 110 down-hole of the anchoring seal 128 and a region of the wellbore 110 up-hole of the anchoring seal 128.

Referring to the example SCU 122' of FIGS. 2A and 2B, each of the anchoring seals 128 of the SCU 122' may include an inflatable ring that is disposed around the exterior of the body 130 of the SCU 122'. Each of the anchoring seals 128 may be inflated from an uninflated (un-deployed) state to an inflated (deployed) state, to secure the SCU 122' in the target zone 124 and create a fluid seal between the SCU body 130 of the SCU 122' and the walls of the wellbore 110. The fluid seal may provide zonal fluid isolation between a region of the wellbore 110 down-hole of the anchoring seal 128 and a region of the wellbore 110 up-hole of the anchoring seal 128. For example, a first deployed anchoring seal 128*a* of the SCU 122' may provide zonal fluid isolation between a first region 110*a* and a second region 110*b* of the wellbore 110, a second deployed anchoring seal 128*b* of the SCU 122' may provide zonal fluid isolation between the second region 110*b* and a third region 110*c* of the wellbore 110, and a third anchoring seal 128*c* of the SCU 122' may provide zonal fluid isolation between the third region 110*c* and a fourth region 110*d* of the wellbore 110.

Referring to the example SCU 122" of FIGS. 3A and 3B, each of the anchoring seals 128 of the SCU 122" may include an inflatable ring that is disposed around the exterior of the body 130 of the SCU 122". Each of the anchoring seals 128 may be inflated from an uninflated (un-deployed) state to an inflated (deployed) state, to secure the SCU 122' in the target zone 124 and create a fluid seal between the SCU body 130 of the SCU 122' and the walls of the wellbore 110. The fluid seal may provide zonal fluid isolation between a region of the wellbore 110 down-hole of the anchoring seal 128 and a region of the wellbore 110 up-hole of the anchoring seal 128. For example, a first deployed anchoring seal 128*d* of the SCU 122" may provide zonal fluid isolation between a first region 110*e* and a second region 110*f* of the wellbore 110, and a second anchoring seal 128*e* of the SCU 122" may provide zonal fluid isolation between the second region 110*f* and a third region 110*g* of the wellbore 110.

Referring to the example SCU 122'" of FIGS. 4A and 4B, the anchoring seal 128 of the SCU 122'" may include an inflatable ring that is disposed around the exterior of the body 130 of the SCU 122'''. The anchoring seal 128 may be inflated from an uninflated (un-deployed) state to an inflated (deployed) state, to secure the SCU 122''' in the target zone 124 and create a fluid seal between the SCU body 130 of the SCU 122''' and the walls of the wellbore 110. The fluid seal may provide zonal fluid isolation between a region of the wellbore 110 down-hole of the anchoring seal 128 and a region of the wellbore 110 up-hole of the anchoring seal 128. For example, the deployed anchoring seal 128 of the SCU 122''' may provide zonal fluid isolation between a first region **110*h* and a second region 110*i* of the wellbore 110**.

The size of a SCU 122 may be defined by the extents of a lateral cross-sectional profile of the SCU 122. A deployed size of a SCU 122 may be defined, for example, by the extents of the lateral cross-sectional profile of the SCU 122 with the centralizers 126 and anchoring seals 128 of the SCU 122 in an extended (deployed) position. An un-deployed size of a SCU 122 may be defined, for example, by the extents of the lateral cross-sectional profile of the SCU 122 with the centralizers 126 and the anchoring seals 128 of the SCU 122 in a retracted (un-deployed) position. The un-deployed size 137 of a SCU 122, for example, be a maximum diameter of the lateral cross-sectional profile of the SCU 122 with the centralizers 126 and anchoring seals 128 of the SCU 122 in a retracted (un-deployed) position. The un-deployed size 137 of a SCU 122 may be, for example, less than the smallest lateral cross-sectional profile of the path that it travels along from the surface 107 to the target zone 124, such as the smallest of the ID of the production tubing 118 and the ID of the intervening portion of the wellbore 110 between the surface 107 and the target zone 124. FIGS. 2B, 3B and 4B illustrate the SCUs 122', 122'' and 122''' in un-deployed configurations, and their respective un-deployed sizes 137. The un-deployed size 137 of each of the SCUs 122', 122'' and 122''' may be defined by the extents of its lateral cross-sectional profile (for example, a minimum diameter that encompasses the entire lateral cross-sectional profile of the SCU).

Figure 5B:
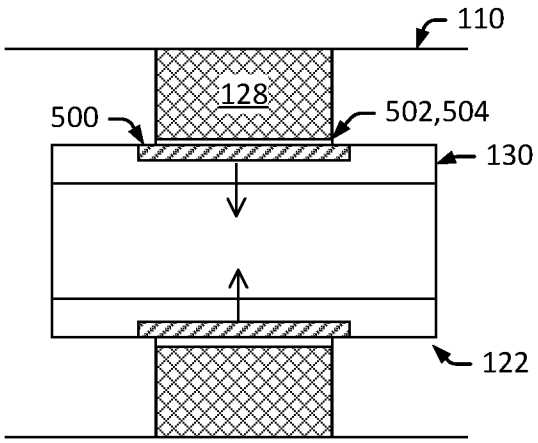
FIGS. 5A-5C are diagrams that illustrate a detachable anchoring seal in accordance with one or more embodiments.
Figure 5A:
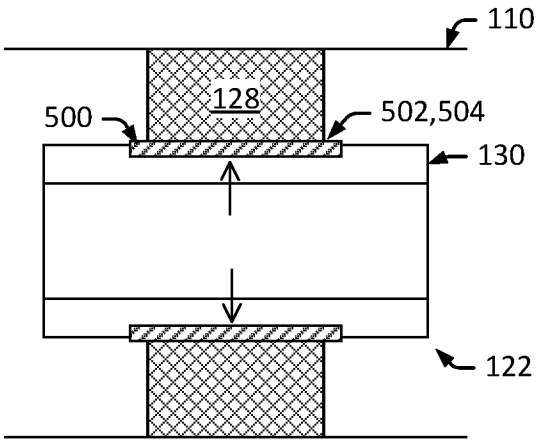
Figure 5C:
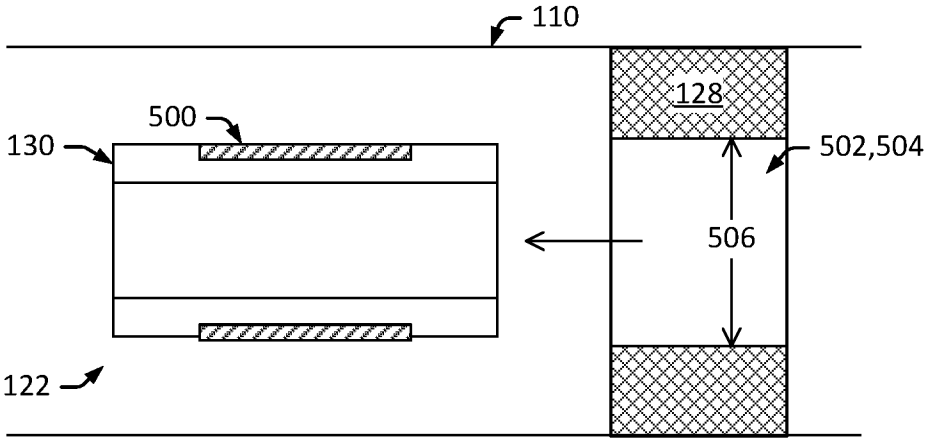

In some embodiments, an anchoring seal 128 is detachable. A detachable anchoring seal 128 may be designed to detach (or "decouple") from a body 130 of a SCU 122. This may enable the SCU 122 to deploy the anchoring seal 128 in a target zone 124, to detach from the anchoring seal 128, and to move from the target zone 124, leaving the anchoring seal 128 deployed in the wellbore 110. This may be advantageous, for example, in the instance a region of the wellbore 110 down-hole of the target zone 124 needs to be accessed. In such an instance, the SCU 122 can be removed (without having to un-deploy the anchoring seal 128), the region of the wellbore 110 down-hole of the target zone 124 can be accessed through a central passage in the anchoring seal 128 that remains deployed in the target zone 124, and once access is no longer needed, the SCU 122 can be returned into position in the target zone 124 and re-attached ("re-coupled") to the anchoring seal 128 still deployed in the target zone 124. In some embodiments, the coupling between a detachable anchoring seal 128 and a body 130 of a SCU 122 is facilitated by a radially expanding member, such as an expandable ring or bladder, located about a circumference of the body 130. Attachment (or "coupling") of the anchoring seal 128 to the body 130 may be provided by radially expanding the radially expanding member to engage and seal against an internal diameter of a central passage of the anchoring seal 128. Detachment (or "decoupling") of the anchoring seal 128 from the body 130 may be provided by radially retracting the radially expanding member to disengage the internal diameter of the central passage of the anchoring seal 128. FIG. 5A is a diagram that illustrates a detachable anchoring seal 128 coupled to a body 130 of a SCU 122 in accordance with one or more embodiments. For example, the body 130 of the SCU 122 includes a radially expanding member 500 expanded radially outward into sealing engagement with an internal surface 502 of a central passage 504 of the detachable anchoring seal 128. FIG. 5B is a diagram that illustrates the detachable anchoring seal 128 decoupled from the body 130 of a SCU 122 in accordance with one or more embodiments. For example, the body 130 of the SCU 122 includes a radially expanding member 500 retracted radially inward to disengage the internal surface 502 of the central passage 504 of the detachable anchoring seal 128. FIG. 5C is a diagram that illustrates the detachable anchoring seal 128 decoupled from the body 130 of a SCU 122, and remaining deployed in the wellbore 110, in accordance with one or more embodiments. With the radially expanding member 500 retracted to disengage the internal surface 502 of the central passage 504 of the detachable anchoring seal 128, the other portions of the SCU 122 (for example, including the body 130 and centralizers 126) may be advanced along a length of the wellbore 110 through and away from the detachable anchoring seal 128, as illustrated by the arrow, leaving the detachable anchoring seal 128 deployed in the wellbore 110. In some embodiments, the radially expanding member 500 includes an expansion ring, such as a ring shaped inflatable bag that is disposed about a circumference of the body 130 of the SCU 122. The expansion ring may, for example, be inflated to engage the internal surface 502 of the central passage 504 of the detachable anchoring seal 128, and be deflated to disengage the internal surface 502 of the central passage 504 of the detachable anchoring seal 128.

The central passage 504 of the detachable anchoring seal 128 may be a cylindrical passage defined by an internal diameter 506. The central passage 502 of the detachable anchoring seal 128 may have a cross-sectional size that is equal to or greater than the cross-sectional size of the body 130 of the SCU 122, and the radially expanding member 500 in a retracted position, to facilitate the removal of the SCU 122 from the detachable anchoring seal 128. In some embodiments, to facilitate passage of down-hole components through a detachable anchoring seal 128 that remains deployed in a wellbore 110, the central passage 502 of the detachable anchoring seal 128 may have a cross-sectional size that is equal to or greater than the cross-sectional size of the production tubing 118 in the wellbore 110. For example, where the production tubing 118 has a minimum ID of about 4 inches (about 10 cm), the central passage 502 of the detachable anchoring seal 128 may have an ID 506 of about 4 inches (about 10 cm) or more. Thus, for example, components that can be passed through the production tubing 118 can also be passed through the central passage 504 of the non-retrievable anchoring seal 128 while it remains deployed in the wellbore 110.

In some embodiments, an anchoring seal 128 is retrievable. A retrievable anchoring seal 128 may be designed to be retrieved from the target zone 124 of the wellbore 110 with or without the SCU 122. For example, a retrievable anchoring seal 128 may be coupled to a SCU 122 during advancement of the SCU 122 to a target zone 124, the SCU 122 may be deployed (for example, including deployment of the anchoring seal 128), the SCU 122 may be operated to provide completion operations (for example, blocking breakthrough substances from entering the flow of production fluid in the wellbore 110), the SCU 122 may be un-deployed (for example, including un-deployment of the anchoring seal 128), and the SCU 122 (including the anchoring seal 128) may be retrieved from the target zone 124. As a further example, a retrievable anchoring seal 128 may be coupled to a SCU 122 during advancement of the SCU 122 to a target zone 124, the SCU 122 may be deployed (for example, including deployment of the anchoring seal 128), the SCU 122 may be operated to provide completion operations (for example, blocking breakthrough substances from entering the flow of production fluid in the wellbore 110), the SCU 122 may be un-deployed (for example, including decoupling of the anchoring seal 128 from the SCU body 130 of the SCU 122), the SCU 122 (not including the anchoring seal 128) may be retrieved from the target zone 124, and the anchoring seal 128 may be subsequently retrieved from the target zone 124. A retrievable anchoring seal 128 may be advantageous, for example, in the event a device needs to be placed down-hole of the target zone 124 and removal of the SCU 122 and the anchoring seal 128 facilitates the passage of the device through the target zone 124.

In some embodiments, an anchoring seal 128 is non-retrievable. A non-retrievable anchoring seal 128 of a SCU 122 may be designed to detach from a body 130 of a SCU 122 and to remain in the target zone 124 of the wellbore 110, even when the remainder of the SCU 122 is retrieved from the target zone 124. For example, a non-retrievable anchoring seal 128 may be coupled to a SCU 122 during advancement of the SCU 122 to a target zone 124, the SCU 122 may be deployed (for example, including deployment of the anchoring seal 128), the SCU 122 may be operated to provide completion operations (for example, blocking breakthrough substances from entering the wellbore 110), the SCU 122 may be un-deployed (for example, including decoupling of the anchoring seal 128 from the SCU body 130 of the SCU 122), the SCU 122 (not including the anchoring seal 128) may be retrieved from the target zone 124, and the anchoring seal 128 may remain deployed in the target zone 124. In some embodiments, a non-retrievable anchoring seal 128 includes an anchoring seal 128 that takes on a hardened form and is thus not capable of being retracted (un-deployed). For example, a non-retrievable anchoring seal 128 of a SCU 122 may include an inflatable bladder that is inflated with a substance in a fluid form, such as cement or epoxy, that subsequently hardens to form a solid-rigid sealing member that extends between a body 130 of the SCU 122 and the walls of the wellbore 110. Such a solid sealing member may provide relatively permanent, secure positioning of the anchoring seal 128 and the SCU 122 in the wellbore 110.

In some embodiments, the SCU 122 includes an onboard (or "local") control system 138 that controls functional operations of the SCU 122. For example, the local control system 138 may include a local communications system 140, a local processing system 142, a local energy system 143, a local sensing system 144, a local flow control system 146, and a positioning control system 147. In some embodiments, the local control system 138 includes a computer system that is the same as or similar to that of computer system 1000 described with regard to at least FIG. 8.

In some embodiments, the local communication system 140 includes a SCU wireless transceiver 148 or a similar wireless communication circuit. The SCU wireless transceiver 148 may provide bi-directional wireless communication with other components of the system, such as the wireless down-hole transceiver 125, the wireless transceiver 123*a* of the motive device 123, or other SCUs 122 located in the wellbore 110. A wireless transceiver may include, for example, an electromagnetic and/or acoustic wireless transceiver. In some embodiments, the SCU wireless transceiver 148 includes one or more wireless antennas 151. A wireless antenna 151 may facilitate wireless communication between the SCU 122 and another device having a complementary wireless antenna. For example, a SCU 122 may include one or both of a first (or "up-hole") antenna 151*a* disposed at an up-hole end of the SCU 122 (for example, in the last 25% of the up-hole end of the length of a body 130 of the SCU 122) and a second (or "down-hole") antenna 151*b* disposed the down-hole end of the SCU 122 (for example, in the last 25% of the down-hole end of the length of the body 130 of the SCU 122). Placement of the up-hole antenna 151*a* in a SCU 122 may help to improve communication with devices located up-hole of the SCU 122, such as the wireless down-hole transceiver 125, the wireless transceiver 123*a* of the motive device 123, or other SCUs 122 located up-hole of the SCU 122 in the wellbore 110. Placement of the down-hole antenna 151*b* in a SCU 122 may help to improve communication with devices located down-hole of the SCU 122, such as other SCUs 122 or the wireless transceiver 123*a* of the motive device 123, located down-hole of the SCU 122 in the wellbore 110.

In some embodiments, the local communication system 140 includes one or more SCU inductive couplers 152. An inductive coupler may enable communication with other devices, such as other SCUs 122, via an inductive coupling between an inductive coupler of the SCU 122 and a complementary inductive coupler of the other devices. For example, a SCU 122 may include one or both of a first (or "up-hole") inductive coupler 152*a* disposed at an up-hole end of a body 130 of the SCU 122, and a second (or "down-hole") inductive coupler 152*b* disposed the down-hole end of the body 130 of the SCU 122. Such a configuration may enable SCUs 122 to communicate with one another via inductive coupling. For example, two SCUs 122 may be assembled such that a down-hole end 132 of a body 130 of a first SCU 122 of the two SCUs 122 mates with (or otherwise abuts against) an up-hole end 134 of a body 130 of a second SCU 122 of the two SCUs 122, and such that a down-hole inductive coupler 152*b* of the first SCU 122 aligns with an up-hole inductive coupler 152*a* of the second SCU 122. In such an embodiment, the local communication systems 140 of the first and second SCUs 122 may communicate with one another by way of inductive coupling between the down-hole inductive coupler 150*b* of the first SCU 122 and the up-hole inductive coupler 152*a* of the second SCU 122.

In some embodiments, the local processing system 142 of a SCU 122 includes a processor that provides processing of data, such as sensor data obtained by way of the local sensing system 144, and controls various components of the SCU 122. This can include controlling positioning control system 147 (for example, including deployment of the centralizers 126 and anchoring seals 128, controlling coupling of the body 130 to detachable anchoring seals 128), controlling operation of the local energy system 143, controlling operation of the local sensing system 144, controlling operation of the local flow control system 146, and controlling operation of the local communication system 140. In some embodiments, the local processing system includes a processor that is the same as or similar to that of processor 1006 of the computer system 1000 described with regard to at least FIG. 8.

In some embodiments, a local energy system 143 of a SCU 122 includes a local energy source. A local energy source may include, for example, an energy harvesting system designed to harvest energy from the down-hole environment, such as a flow energy harvester, a vibration energy harvester, or a thermal energy harvester. The local energy source may include local energy storage, such as rechargeable batteries, ultra-charge capacitors, or mechanical energy storage devices (for example, a flywheel). In some embodiments, a local energy system 143 of a SCU 122 may harvest energy from production fluids or other substances flowing through or otherwise present in a central passage 136 of the SCU 122. For example, a local energy system 143 of a SCU 122 may include a flow energy harvester including a turbine that is disposed in a central passage 136 of a SCU body 130 of the SCU 122, and that is operated to extract energy from production fluids flowing through the central passage 136. The extracted energy may be used to charge a battery of the SCU 122. The energy generated and the energy stored may be used to power functional operations of the SCU 122.

In some embodiments, a local sensing system 144 of a SCU 122 includes sensors for detecting various down-hole conditions, such as temperature sensors, pressure sensors, flow sensors, water-cut sensors, and water saturation sensors. In some embodiments, a set of sensors may be provided to acquire measurements of conditions of the zonally isolated regions. Referring to the example SCU 122' of FIG. 2A, for example, respective first, second, third and fourth sets of sensors 150*a*, 150*b*, 150*c*, 150*d* (for example, respective sets of temperature sensors, pressure sensors, flow sensors, water-cut sensors, and water saturation sensors) may detect respective sets of conditions (for example, respective sets of temperature pressure, flow, water-cut and water saturation) in the respective first, second, third and fourth regions 110*a*, 110*b*, 110*c* and 110*d*. Referring to the example SCU 122" of FIG. 3A, for example, respective first, second, and third sets of sensors 150*e*, 150*f* and 150*g* may detect respective sets of conditions in the respective first, second, and third regions 110*e*, 110*f* and 110*g*. Referring to the example SCU 122''' of FIG. 4A, for example, respective first and second sets of sensors 150*h* and 150*i* may detect respective sets of conditions in the first and second regions 110*h* and 110*i*.

In some embodiments, a local flow control system 146 of a SCU 122 includes valves or similar flow control devices for controlling the flow of fluids from the target zone 124, the upstream flow of production fluid from down-hole of the SCU 122 and the target zone 124, and the downstream flow of injection fluids from up-hole of the SCU 122 and the target zone 124. In some embodiments, the central passage 136 of an SCU 122 provides fluid communication between some of all of the zonally isolated regions created by the SCU 122, and a local flow system 146 of the SCU 122 includes one or more valves to selectively control the flow of fluid between the zonally isolated regions and the central passage 136. Referring to the example SCU 122' of FIG. 2A, for example, first, second, third and fourth valves 162*a*, 162*b*, 162*c* and 162*d* may control the flow of fluid into the central passage 136 from the respective first, second, third and fourth regions 110*a*, 110*b*, 110*c* and 110*d*. The first valve 162*a* and the fourth valve 162*d* may be opened, and the second valve 162*b* and the third valve 162*c* may be closed, to enable production fluid to flow upstream from the fourth region 110*d* into the first region 110*a*, while preventing breakthrough fluid in the second region 110*b* and the third region 110*c* from flowing into the production fluid and the first region 110*c*. The second region 110*b* and the third region 110*c* may be referred to as target regions of the target zone 124 in which the SCU 122' is deployed. Referring to the example SCU 122" of FIG. 3A, for example, first, second, and third valves 162*e*, 162*f* and 162*g* may control the flow of fluid into the central passage 136 from the respective first, second and third regions 110*e*, 110*f*, and 110*g*. The first valve 162*e* and the third valve 162*g* may be opened, and the second valve 162*f* may be closed, to enable production fluid to flow upstream from the third region 110*g* into the first region 110*e*, while preventing breakthrough fluid in the second region 110*f* from flowing into the production fluid and the first region 110*e*. The second region 110*f* may be referred to as the target region of the target zone 124 in which the SCU 122" is deployed. Referring to the example SCU 122''' of FIG. 4A, for example, respective first, second and third valves 162*h*, 162*i* and 162*j* may control the flow of fluid into the central passage 136 from the respective first and second regions 110*h* and 110*i*.

A valve may include, for example, a sliding sleeve, a ball valve, or similar device. Referring to the example SCU 122" of FIG. 3A, for example, the valve 162*b* may include an inflow control valve (ICV) including a tubular sleeve 163 disposed in the central passage 136 of the SCU 122", and disposed adjacent perforations 164 that extend radially through the body 130 of the SCU 122". The tubular sleeve 163 may have complementary perforations 166 that extend radially through the tubular sleeve 163. During operation of the valve 162*b*, the sleeve 163 may be advanced (for example, rotated laterally within the central passage 136 or slid longitudinally along a length of the central passage 136) into an opened position that includes aligning the perforations 166 of the tubular sleeve 163 with the complementary perforations 164 of the body 130 of the SCU 122", to define an opened path between the central passage 136 and the second region 110*f* external to the body 130 that enables the flow of substances between the central passage 136 and the second region 110*f*. The sleeve 163 may be advanced into a closed position that includes the perforations 166 of the tubular sleeve 163 and the perforations 164 of the body 130 of the SCU 122" being fully offset from one another, to block the flow of substances between the central passage 136 and the second region 110*f*. The sleeve 163 may be advanced into a partially opened position that includes partially aligning (or "partially offsetting") the perforations 166 of the tubular sleeve 163 with the perforations 164 of the body 130 of the SCU 122" to define a partially opened path between the central passage 136 and the second region 110*f*, to enable restricted (or "throttled") flow of substances between the passage 160 and the second region 110*f*.

In some embodiments, a positioning control system (also referred to as a "centralizer control system" or an "anchoring seal control system") 147 of a SCU 122 includes one or more devices for controlling operations of the centralizers 126, the anchoring seals 128 and a radially expanding member ("expansion member") 500 of the SCU 122. For example, the positioning control system 147 of an SCU 122 may include one more mechanical actuators that provide the motive force to move the centralizers 126 between un-deployed and deployed positions. As a further example, the positioning control system 147 of an SCU 122 may include a fluid pump that supplies fluid pressure to deploy or un-deploy one or more anchoring seals 128. Deployment of an anchoring seal 128 may include the fluid pump pumping fluid from an on-board fluid reservoir, into an inflatable bladder of the anchoring seal 128 to inflate the bladder. Un-deployment of an anchoring seal 128 may include the fluid pump pumping fluid out of the inflatable bladder of the anchoring seal 128, into the on-board fluid reservoir, to deflate the bladder. As a further example, the positioning control system 147 of an SCU 122 may include a fluid pump that supplies fluid pressure to deploy or un-deploy a radially expanding member 500 of the SCU 122. Deployment of a radially expanding member 500 may include the fluid pump pumping fluid from an on-board fluid reservoir, into an inflatable bladder of the radially expanding member 500 to inflate the bladder, and to cause the bladder to expand radially into sealing contact with an internal surface 502 of a central passage 504 of the detachable anchoring seal 128. Un-deployment of a radially expanding member 500 may include the fluid pump pumping fluid out of the inflatable bladder of the radially expanding member 500, into the on-board fluid reservoir, to deflate the bladder, and to cause the bladder to retract radially out of sealing contact with the internal surface 502 of the central passage 504 of the detachable anchoring seal 128.

In some embodiments, a SCU 122 is formed of one or more SCU modules (SCUMs). For example, multiple SCUMs may be assembled (for example, coupled end-to-end) to form a SCU 122 that is or can be deployed in a target zone 124. In some embodiments, SCUMs are delivered to a target zone 124 individually or preassembled with other SCUMs. For example, multiple SCUMs may be passed through the production tubing 118 and the wellbore 110 one-by-one, and be coupled end-to-end, to form the SCU 122*a* down-hole, in the target zone 124*a*. In some embodiments, multiple SCUMs can be pre-assembled before being run down-hole to form some or all of a SCU 122 to be disposed in a target zone 124. For example, three SCUMs may be coupled end-to-end at the surface 107, to form the SCU 122*b* at the surface 107, and the assembled SCU 122*b* (including the three SCUMs) may be run through the production tubing 118 and the wellbore 110 into the target zone 124*b*. If additional SCUMs are needed, the additional SCUMs can be provided in separate runs. For example, where five SCUMs are needed in the target zone 124*b*, two additional SCUMs may be run through the production tubing 118 and the wellbore 110 into the target zone 124, and be coupled against the up-hole end of the three SCUMs already located in the target zone 124*b* of the wellbore 110 to form the SCU 122. Thus, the SCUMs can be positioned and assembled in a modular fashion to form a modular type SCU 122 down-hole, without having to remove production tubing 118 of a well system 106.

In some instances, it can be advantageous to run SCUMs individually, or at least with a lesser number of assembled SCUMs, as the smaller size may facilitate passage through the production tubing 118 and wellbore 110. For example, a lesser number of assembled SCUMs may have a relatively short overall length, as compared to the fully assembled SCU 122, that facilitates navigating relatively tight bends in the production tubing 118 and the wellbore 110. Further, a lesser number of assembled SCUMs may have a relatively low weight, as compared to a fully assembled SCU 122, that facilitates advancing the SCUMs through the production tubing 118 and the wellbore 110. In some instances, it can be advantageous to run a greater number of assembled SCUMs, or even a fully assembled SCU 122, to reduce the number of runs needed to deliver the SCU 122 to the target zone 124. How a SCUMs of a modular SCU 122 are delivered may be based on the complexity of the well 108, such as the size length, and trajectory of the production tubing 118 and the wellbore 110.

Figure 6A:
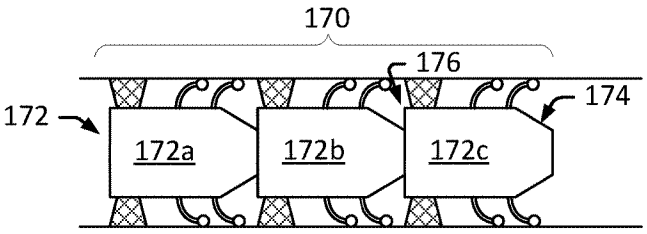
FIGS. 6A-6D are diagrams that illustrate modular SCUs in accordance with one or more embodiments.
Figure 6B:
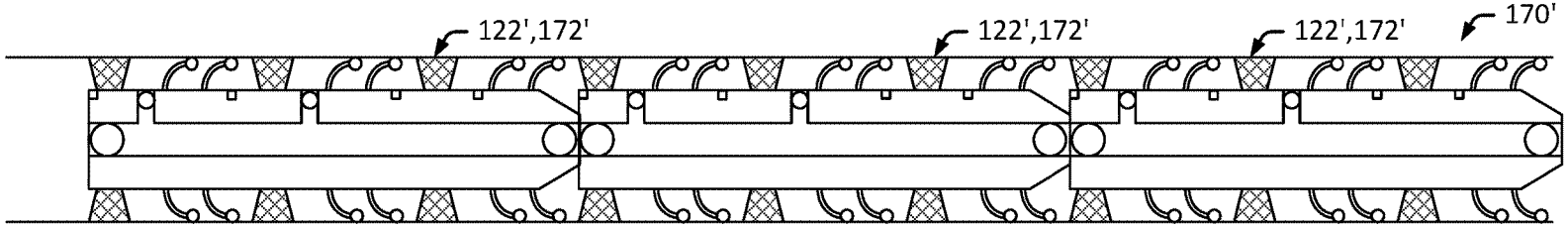
Figure 6C:
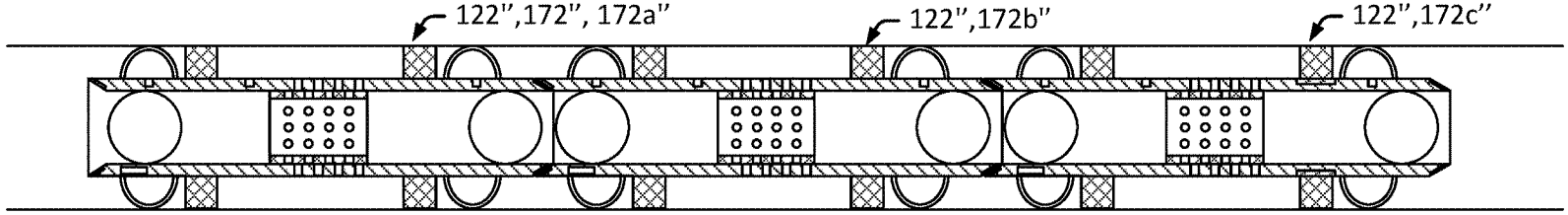
Figure 6D:
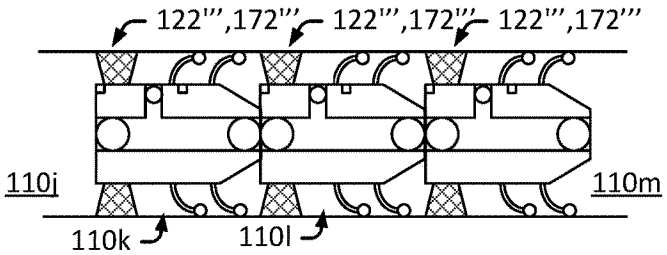

FIG. 6A is a diagram that illustrates a modular SCU 170 formed of multiple SCUMs 172 (including SCUM 172*a*, SCUM 172*b* and SCUM 172*c*), in accordance with one or more embodiments. Each SCUM 172 may have a first ("leading" or "down-hole") end 174 and a second ("trailing" or "up-hole") end 176. In some embodiments, first and second ends 174 and 176 of two respective SCUMs 172 are coupled to (or otherwise abutted against) one another to form a modular SCU 170. Although certain embodiments are described in the context of a modular SCU 170 formed of three SCUMs 172 for the purpose of illustration, a modular SCU 170 may include any suitable number of SCUMs 172. In some embodiments, an SCU 122 may be a modular SCU 170. For example, the SCU 122*a*, the SCU 122*b* or the SCU 122*c* may be a modular type SCU 122. Moreover, although the modular components of a modular SCU 170 are described as SCUMs 172 for the purpose illustration, in some embodiments, a SCUM 172 can include one of the SCUs 122 described here. For example, a modular SCU 122 may be formed of multiple SCUs 122' coupled end-to-end, multiple SCUs 122" coupled end-to-end, multiple SCUs 122'" coupled end-to-end, or any combination of the three coupled end-to-end. For example, FIGS. 6B, 6C and 6D are diagrams that illustrate example modular SCUs 170 formed of multiple SCUs 122 (SCUMs 172) in accordance with one or more embodiments. FIG. 6B is a diagram that illustrates a longitudinal cross-sectioned view of an example modular SCUs 172' formed of multiple SCUs 122' (SCUMs 172') coupled end-to-end in accordance with one or more embodiments. FIG. 6C is a diagram that illustrates a longitudinal cross-sectioned view of an example modular SCU 170" formed of multiple SCUs 122" (SCUMs 172") coupled end-to-end in accordance with one or more embodiments. FIG. 6D is a diagram that illustrates a longitudinal cross-sectioned view of an example modular SCUs 170' formed of multiple SCUs 122'" (SCUMs 172'") coupled end-to-end in accordance with one or more embodiments.

In some embodiments, the multiple SCUMs 172 of a modular SCU 170 are operated in coordination to provide an expanded set of down-hole completion operations. Referring to the modular SCU 122 of FIG. 6D, for example, where three SCUs 122' (SCUMs 172') are coupled end-to-end in the target zone 124, the first valves 162*h* and the third valves 162*j* of the three SCUs 122' (SCUMs 172'") may be opened, and the second valves 162*i* of the three SCUs 122' (SCUMs 172'") may be closed, to enable production fluid to flow upstream from a region 110*m* down-hole of the modular SCU 170' to a region 110*j* up-hole of the modular SCU 170'", and to prevent breakthrough fluid in the regions 110*k* and 110*l* from flowing into the production fluid and the regions 110*j* and 110*m*.

In some embodiments, SCUMs 172 of a modular SCU 170 are delivered to a target zone 124 individually. For example, multiple SCUMs 172 may be passed through the production tubing 118 and wellbore 110 of the well 108 one-by-one, and be coupled together end-to-end in the target zone 124 to form a modular SCU 170 down-hole. Referring to FIG. 6A, for example, the first SCUM 172*a* may be passed through the production tubing 118 and the wellbore 110 of the well 108, and be disposed in target zone 124. The second SCUM 172*b* may then be passed through the production tubing 118 and the wellbore 110 of the well 108, and be disposed in target zone 124 such that a leading end 174 of the second SCUM 172*b* couples to a trailing end 176 of the first SCUM 172*a*. The third SCUM 172*b* may then be passed through the production tubing 118 and the wellbore 110 of the well 108, and be disposed in target zone 124, such that a leading end 174 of the third SCUM 172*b* couples to the trailing end 176 of the second SCUM 200*a*. In some embodiments, SCUMs 172 of a modular SCU 170 are delivered to a target zone 124 preassembled with other SCUMs 172 of the modular SCU 170. For example, referring to FIG. 6A, the three SCUMs 172*a*, 172*b* and 172*c* may be assembled end-to-end at the surface 107 (for example, such that such that a leading end 174 of the second SCUM 172*b* couples to a trailing end 176 of the first SCUM 172*a*, and a leading end 174 of the third SCUM 172*b* couples to the trailing end 176 of the second SCUM 200*a*), and be run as an assembled unit through the production tubing 118 and the wellbore 110, to the target zone 124. In some embodiments, additional SCUMs 172 can be provided in separate runs. For example, where five SCUMs 172 are needed in the target zone 124, two additional SCUMs 172 may be assembled at the surface 107, and be run as an assembled unit through the production tubing 118 and the wellbore 110, to the target zone 124. The two additional SCUMs 172 may be assembled with (for example, coupled against an up-hole end of) the three SCUMs 172 already disposed in the target zone 124. Thus, the SCUMs 172 can be positioned and assembled in a modular fashion to form a modular SCU 170 down-hole, without having to remove production tubing 118 from a well 108. As noted, in some embodiments, a modular SCU 170 is run as a complete system. For example, where five SCUMs 172 are needed in a target zone 124, five SCUMs 172 may be assembled at the surface 107, and be run as an assembled unit through the production tubing 118 and the wellbore 100, into the target zone 124.

In some embodiments, each SCUMs 172 of a modular SCU 170 can communicate individually with the down-hole wireless transceiver 125. For example, referring to the modular SCU 170" of FIG. 6C (formed of multiple SCUs 122") (SCUMs 172*a*", 172*b*" and 172*c*") coupled end-to-end, the wireless transceiver 148 of each of the first SCUM 172*a*", the second SCUM 1720*b*" and the third SCUM 172*c*" may communicate directly with the down-hole wireless transceiver 125 by way of its up-hole antenna 151*a*. In some embodiments, the SCUMs 172 of a modular SCU 170 can communicate with one another. For example, referring again to the modular SCU 170" of FIG. 6C, the first SCUM 172*a*" may communicate with the second SCUM 172*b*" by way of their respective local communication systems 140. This can include, for example, communication by way of wireless communication between their respective wireless transceivers 148 or by way of inductive coupling between them (for example, by way of inductive coupling between the up-hole and down-hole inductive couplers 152*a* and 152*b* of the second and first SCUMs 172*b*" and 172*a*", respectively). The first SCUM 172*a*" may communicate with the third SCUM 172*c*" by way of their respective local communication systems 140. This can include, for example, by way of wireless communication between their respective wireless transceivers 148 or by way of inductive coupling between them (for example, by way of inductive coupling between the up-hole and down-hole inductive couplers 152*a* and 152*b* of the third and second SCUMs 172*c*" and 172*b*", respectively, and inductive coupling between the up-hole and down-hole inductive couplers 152*a* and 152*b* of the second and first SCUMs 172*b*" and 172*a*", respectively).

In some embodiments, the SCUMs 172 of a modular SCU 170 may have coordinated communication with the down-hole wireless transceiver 125. An up-hole most SCUM 172 of a modular SCU 170 may communicate directly with devices up-hole of the SCU 170, such as the down-hole wireless transceiver 125, and a down-hole most SCUM 172 of a modular SCU 170 may communicate directly with devices down-hole of the SCU 170. For example, referring again to the modular SCU 170" of FIG. 6C, the wireless transceiver 148 of the first SCUM 172*a*" may communicate directly with the down-hole wireless transceiver 125 by way of its first antenna 151*a*, and act an intermediary to relay communications between the down-hole wireless transceiver 125 and the second and third SCUMs 172*b*" and 172*c*". Further, the wireless transceiver 148 of the third SCUM 172*b*" may communicate directly with a wireless transceiver 125 of a device, such as another SCU 122, located down-hole of the modular SCU 170 by way of its second antenna 151*b*, and act an intermediary to relay communications between the device located down-hole of the modular SCU 170 and the first and second SCUMs 172*a*" and 172*b*".

Figure 7:
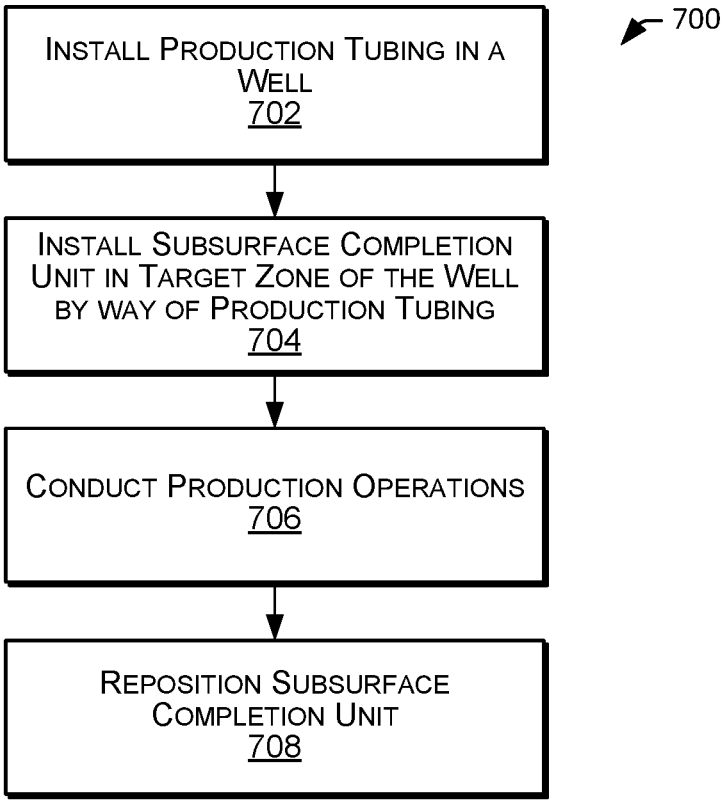
FIG. 7 is a flowchart that illustrates a method of operating a well using a thru-tubing completion system (TTCS) employing SCUs in accordance with one or more embodiments.

FIG. 7 is a flowchart that illustrates a method 700 of operating a well using a thru-tubing completion system employing SCUs in accordance with one or more embodiments. The method 700 may generally include installing production tubing in a well (block 702), installing a SCU in a target zone of the well by way of the production tubing (block 704), conducting production operations using the SCU (block 706), and repositioning the SCU (block 708).

In some embodiments, installing production tubing in a well (block 402) includes installing production tubing in the wellbore of a well. For example, installing production tubing in a well may include installing the production tubing 118 in the wellbore 110 of the well 108. In some embodiments, installing production tubing includes installing a down-hole wireless transceiver at the end of the production tubing. For example, installing the production tubing 118 may include installing the down-hole wireless transceiver 125 within about 20 feet (about 6 meters) of the down-hole end 118*a* of the production tubing 118.

In some embodiments, installing a SCU in a target zone of the well by way of the production tubing (block 404) includes installing a SCU 122 in a target zone 124 of the well 108 by way of the production tubing 118 and an intervening portion of the wellbore 110 of the well 108. For example, installing a SCU in a target zone of the well by way of the production tubing may include passing the SCU 122*a* through and interior of the production tubing 118 and the interior of the intervening portion of the wellbore 110, located between the down-hole end 118*a* of the production tubing 118 and the target zone 124*a*, to position the SCU 122*a* in the target zone 124*a*. In some embodiments, a SCU 122 is advanced through the production tubing 118 or the wellbore 110, into the target zone 124, by way of a motive force (for example, pushing and pulling) provided by the positioning device 123. In some embodiments, installing a SCU 122 in a target zone 124 includes deploying positioning devices to secure the SCU 122 in the target zone 124 or to provide zonal fluid isolation of regions in the target zone 124. For example, installing the SCU 122*a* in the target zone 124*a* may include deploying one or more centralizers 126 of the SCU 122*a* to center the SCU 122*a* in the wellbore 110, and then deploying one or more anchoring seals 128 of the SCU 122*a* to secure the SCU 122*a* in the target zone 124*a* and create a fluid seal between a body 130 of the SCU 122*a* the walls of the target zone 124*a* of the wellbore to provide zonal fluid isolation of a region in the target zone 124*a*. FIGS. 2A, 3A and 4A illustrate example SCUs 122, including SCUs 122', 122" and 122'", installed in respective target zones 124 of a wellbore 110.

In some embodiments, installing a SCU in a target zone of the well by way of the production tubing includes installing a modular type SCU. For example, referring to FIG. 6A, three SCUMs 172*a*, 172*b*, and 172*c* may be passed though the production tubing 118 and installed in the target region 124 to provide the modular SCU 172 installed in the target region 124. As described, the SCUMs 172 may be delivered to the target zone 124 individually or together with other SCUMs 172. For example, multiple SCUMs 172 may be passed through the production tubing 118 of the well 108, one-by-one, and be coupled together end-to-end in the target zone 124 to form the modular SCU 170 down-hole. As a further example, multiple SCUMs 172 may be pre-assembled before being run down-hole to form some or all of a modular SCU 170 disposed in a target zone 124. FIGS. 6B, 6C and 6D are diagrams that illustrate example modular SCUs 170, including modular SCUs 170', 170" and 170'", in accordance with one or more embodiments.

In some embodiments, conducting production operations using the SCU (block 406) includes operating the SCU to provide various functional productions operations. For example, conducting production operations using a SCU can include operating valves of an installed SCU 122 to regulate production flow and acquiring measurements of down-hole conditions. In some embodiments, conducting production operations using the SCU includes operating the valves of a SCU 122 to provide a desired level of zonal isolation. Referring to FIG. 2A, for example, first, second, third and fourth valves 162*a*, 162*b*, 162*c* and 162*d* may be operated control the flow of fluid into the passage 136 of the SCU 122' from the respective first, second, third and fourth regions 110*a*, 110*b*, 110*c* and 110*d*. Referring to the example SCU 122" of FIG. 3A, for example, first, second, and third valves 162*e*, 162*f* and 162*g* may be operated to control the flow of fluid into the passage 136 of the SCU 122" from the respective first, second and third regions 110*e*, 110*f*, and 110*g*. Referring to the example SCU 122'" of FIG. 4A, for example, respective first, second and third valves 162*h*, 162*i* and 162*j* may be operated to control the flow of fluid into the passage 136 of the SCU 122'" from the respective first and second regions 110*h* and 110*i*.

In some embodiments, conducting production operations using the SCU includes monitoring down-hole conditions using the SCU. For example, conducting production operations using a SCU may include monitoring the various regions using sensors of an installed SCU 122. Referring to the example SCU 122' of FIG. 2A, for example, respective first, second, third and fourth sets of sensors 150*a*, 150*b*, 150*c*, 150*d* may detect respective sets of conditions of the respective first, second, third and fourth regions 110*a*, 110*b*, 110*c* and 110*d*. Referring to the example SCU 122" of FIG. 3A, for example, respective first, second, and third sets of sensors 150*e*, 150*f*, and 150*g* may detect respective sets of conditions of the respective first, second and third regions 110*e*, 110*f*, and 110*g*. Referring to the example SCU 122'" of FIG. 4A, for example, respective first, second, and third sets of sensors 150*h* and 150*i* may detect respective sets of conditions of the respective first and second regions 110*h* and 110*i*. Sensed data indicative of the sensed conditions may be processed locally (for example, by the local processing system 142) to generate processed sensor data, and the processed sensor data may be transmitted to the surface control unit 109*a* (for example, by way of the SCU wireless transmitter 148 and the down-hole wireless transmitter 125) for further processing. In some embodiments, the raw sensed data may be transmitted to the surface control unit 109*a*.

In some embodiments, repositioning the SCU (block 408) includes removing the SCU from the well by way of the production tubing. For example, if all of the anchoring seals 128 of the SCU 122*a* are retrievable, repositioning the SCU 122*a* from the target zone 124*a* may include un-deploying the anchoring seals 128 and centralizers 126 of the SCU 122*a*, and removing the SCU 122*a* (including the retrievable anchoring seals 128) from the target zone 124*a*, through the wellbore 110 and the production tubing 118. As a further example, if some of the anchoring seals 128 of the SCU 122*b* are detachable, repositioning the SCU 122*b* from the target zone 124*b* may include un-deploying the centralizers 126 and any retrievable anchoring seals 128, detaching the detachable anchoring seals 128 from the body 130 of the SCU 122*b*, and removing the SCU 122*b* (except for the detached anchoring seals 128) from the target zone 124*b*, through the wellbore 110 and the production tubing 118. In such an embodiment, the detached anchoring seals 128 may remain fixed in the target zone 124*b*. In some embodiments, repositioning a SCU 122 includes moving the SCU 122 within the wellbore 110, without returning the SCU 122 to the surface 107. For example, if all of the anchoring seals 128 of the SCU 122*a* are retrievable, un-installing the SCU 122*a* from the target zone 124*a* may include un-deploying the anchoring seals 128 and centralizers 126 of the SCU 122*a*, and moving the SCU 122*a* (including the retrievable anchoring seals 128) through the wellbore 110, from the target zone 124*a* to the target zone 124*c*. The SCU 122*a* may be redeployed in the target zone 124*c* to provide completion operations in the target zone 124*c*. In some embodiments, a SCU 122 is repositioned using a positioning device 123, such as a tractor, to provide motive force (for example, pulling or pushing) to advance the SCU 122 through some or all of the wellbore 110 and the production tubing 118.

Such embodiments of a well system employing SCUs can provide an on-demand and modular completion solution that can be employed without the time and costs traditionally associated with workover procedures that require removing production tubing. For example, instead of having to bring in a workover rig to remove the production tubing string to provide access for working over a targeted zone in a wellbore, a well operator can simply pass a SCU through the production tubing into position within the target zone of the wellbore to provide the needed workover operations. This can facilitate conducting well completion operations on-demand, as conditions dictate. Moreover, the ability to install different SCUs in different target zones provide a flexible solution that can be customized for a variety of down-hole conditions. For example, different combinations and types of SCUs and SCUMs can be installed, retrieved, and repositioned as conditions dictate. Thus, embodiments of the TTCS may provide a flexible, cost and time effective completion solution that addresses ever changing well conditions and production goals.

Figure 8:
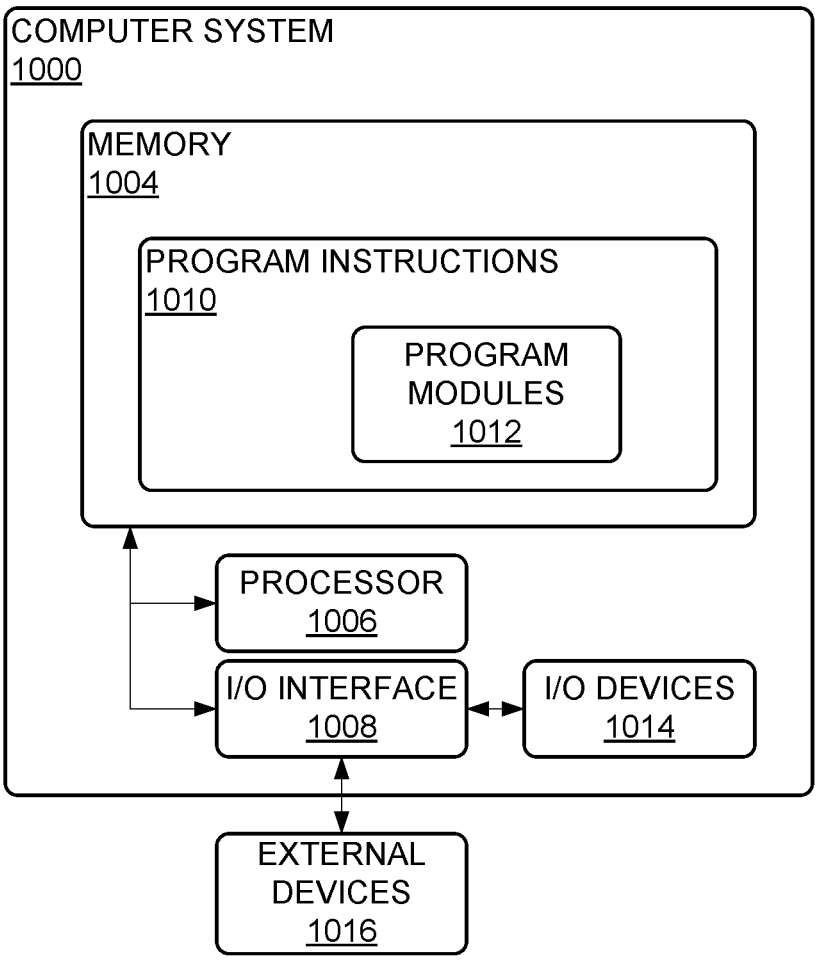
FIG. 8 is a diagram that illustrates an example computer system in accordance with one or more embodiments.

FIG. 8 is a diagram that illustrates an example computer system 1000 in accordance with one or more embodiments. In some embodiments, the system 1000 may be a programmable logic controller (PLC). The system 1000 may include a memory 1004, a processor 1006, and an input/output (I/O) interface 1008. The memory 1004 may include non-volatile memory (for example, flash memory, read-only memory (ROM), programmable read-only memory (PROM), erasable programmable read-only memory (EPROM), electrically erasable programmable read-only memory (EEPROM)), volatile memory (for example, random access memory (RAM), static random access memory (SRAM), synchronous dynamic RAM (SDRAM)), bulk storage memory (for example, CD-ROM and/or DVD-ROM, hard drives), and/or the like. The memory 1004 may include a non-transitory computer-readable storage medium storing program instructions 1010. The program instructions 1010 may include program modules 1012 that are executable by a computer processor (for example, the processor 1006) to cause the functional operations described here, including those described with regard to the surface control system 109*a*, the local control system 138, and the method 700.

The processor 1006 may be any suitable processor capable of executing program instructions. The processor 1006 may include a central processing unit (CPU) that carries out program instructions (for example, the program instructions of the program module(s) 1012) to perform the arithmetical, logical, and input/output operations described herein. The processor 1006 may include one or more processors. The I/O interface 1008 may provide an interface for communication with one or more I/O devices 1014, such as a joystick, a computer mouse, a keyboard, a display screen (for example, an electronic display for displaying a graphical user interface (GUI)), or the like. The I/O devices 1014 may include one or more of the user input devices. The I/O devices 1014 may be connected to the I/O interface 1008 by way of a wired (for example, Industrial Ethernet) or a wireless (for example, Wi-Fi) connection. The I/O interface 1008 may provide an interface for communication with one or more external devices 1016, such as other computers, networks, and/or the like. In some embodiments, the I/O interface 1008 may include an antenna, a transceiver, and/or the like. In some embodiments, the external devices 1016 may include a tractor, sensors, centralizers, anchoring seals, and/or the like.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described here are to be taken as examples of embodiments. Elements and materials may be substituted for those illustrated and described here, parts and processes may be reversed or omitted, and certain features of the embodiments may be utilized independently, all as would be apparent to one skilled in the art after having the benefit of this description of the embodiments. Changes may be made in the elements described here without departing from the spirit and scope of the embodiments as described in the following claims. Headings used herein are for organizational purposes only and are not meant to be used to limit the scope of the description.

It will be appreciated that the processes and methods described here are example embodiments of processes and methods that may be employed in accordance with the techniques described. The processes and methods may be modified to facilitate variations of their implementation and use. The order of the processes and methods and the operations provided may be changed, and various elements may be added, reordered, combined, omitted, modified, etc. Portions of the processes and methods may be implemented in software, hardware, or a combination thereof. Some or all of the portions of the processes and methods may be implemented by one or more of the processors, modules, or applications described here.

As used throughout this application, the word "may" is used in a permissive sense (such as, meaning having the potential to), rather than the mandatory sense (such as, meaning must). The words "include," "including," and "includes" mean including, but not limited to. As used throughout this application, the singular forms "a", "an," and "the" include plural referents unless the content clearly indicates otherwise. Thus, for example, reference to "an element" may include a combination of two or more elements. As used throughout this application, the phrase "based on" does not limit the associated operation to being solely based on a particular item. Thus, for example, processing "based on" data A may include processing based at least in part on data A and based at least in part on data B unless the content clearly indicates otherwise. As used throughout this application, the term "from" does not limit the associated operation to being directly from. Thus, for example, receiving an item "from" an entity may include receiving an item directly from the entity or indirectly from the entity (for example, by way of an intermediary entity). Unless specifically stated otherwise, as apparent from the discussion, it is appreciated that throughout this specification discussions utilizing terms such as "processing," "computing," "calculating," "determining," or the like refer to actions or processes of a specific apparatus, such as a special purpose computer or a similar special purpose electronic processing/computing device. In the context of this specification, a special purpose computer or a similar special purpose electronic processing/computing device is capable of manipulating or transforming signals, typically represented as physical, electronic or magnetic quantities within memories, registers, or other information storage devices, transmission devices, or display devices of the special purpose computer or similar special purpose electronic processing/computing device.

What is claimed is:

1. A thru-tubing completion system comprising:

a sub-surface completion unit (SCU) configured to pass through production tubing disposed in a wellbore of a well and to be disposed in a target zone of an open-holed portion of the wellbore and perform completion operations in the target zone, the SCU comprising:

a SCU wireless transceiver;

one or more SCU anchoring seals configured to be positioned in an un-deployed position and a deployed position, the un-deployed position of the one or more SCU anchoring seals enabling the SCU to pass through the production tubing disposed in the wellbore of the well, and the deployed position of the one or more SCU anchoring seals providing a seal against a wall of the target zone of the open-holed portion of the wellbore to provide zonal isolation between regions in the wellbore; and one or more SCU centralizers configured to be positioned in an un-deployed position and a deployed position, the un-deployed position of the one or more SCU centralizers enabling the SCU to pass through the production tubing disposed in the wellbore of the well, and the deployed position of the one or more SCU centralizers positioning the SCU in the target zone of the open-holed portion of the wellbore, wherein the SCU comprises a plurality of SCU modules (SCUMs) configured to be advanced through the production tubing unassembled, and to be assembled to one another in the open-holed portion of the wellbore to form the SCU down-hole after the SCUMs are passed through the production tubing; and a down-hole wireless transceiver configured to be disposed at a down-hole end of the production tubing in the wellbore of the well, to be communicatively coupled to a surface control system of the well, to communicate wirelessly with the SCU wireless transceiver, and to provide for communication between the SCU wireless transceiver and the surface control system of the well.

2. The system of claim 1, wherein the un-deployed position of the one or more SCU anchoring seals comprises the one or more SCU anchoring seals having an outer diameter that is less than an inner diameter of the production tubing, and wherein the deployed position of the one or more SCU anchoring seals comprises the one or more SCU anchoring seals having an outer diameter that is equal to or greater than an inner diameter of the wall of the target zone of the open-holed portion of the wellbore.

3. The system of claim 1, wherein the un-deployed position of the one or more SCU centralizers comprises the one or more SCU centralizers having an outer diameter that is less than an inner diameter of the production tubing, and wherein the deployed position of the one or more one or more SCU centralizers comprises the one or more one or more SCU centralizers having an outer diameter that is equal to or greater than an inner diameter of the wall of the target zone of the open-holed portion of the wellbore.

4. The system of claim 1, wherein at least one of the one or more anchoring seals is retrievable, and wherein the at least one of the one or more anchoring seals that is retrievable is configured to be removed from the target zone with a body of the SCU when the body of the SCU is removed from the target zone.

5. The system of claim 1, wherein at least one of the one or more anchoring seals is detachable, and wherein the at least one of the one or more anchoring seals that is detachable is configured to detach from a body of the SCU and remain in the target zone when the body of the SCU is removed from the target zone.

6. The system of claim 5, wherein the at least one of the one or more anchoring seals that is detachable comprises an interior passage having an internal diameter that is equal to or greater than an internal diameter of the production tubing.

7. The system of claim 1, wherein at least one of the one or more anchoring seals is non-retrievable, and wherein the at least one of the one or more anchoring seals that is non-retrievable is configured to be inflated with a hardening substance and to detach from a body of the SCU and remain in the target zone when the body of the SCU is removed from the target zone.

8. The system of claim 7, wherein the at least one of the one or more anchoring seals that is non-retrievable comprises an interior passage having an internal diameter that is equal to or greater than an internal diameter of the production tubing.

9. The system of claim 1, wherein the deployed position of the one or more SCU anchoring seals is configured to isolate a region of the target zone comprising a breakthrough of fluid to inhibit the fluid of the breakthrough from flowing into the wellbore.

10. The system of claim 1, wherein the SCU wireless transceiver is configured to, in response to establishing commutation with the surface control system of the well, communicate directly with the surface control system of the well.

11. The system of claim 1, further comprising a positioning device configured to provide a motive force to advance the SCU through the production tubing and the wellbore.

12. The system of claim 11, further comprising:

the production tubing disposed in the wellbore; and the surface control system of the well.

13. A thru-tubing completion system comprising:

a surface control system;

production tubing disposed in a wellbore of a well;

a sub-surface completion unit (SCU) configured to pass through the production tubing and to be disposed in a target zone of an open-holed portion of the wellbore and perform completion operations in the target zone, the SCU comprising:

a SCU wireless transceiver;

one or more SCU anchoring seals configured to be positioned in an un-deployed position and a deployed position, the un-deployed position of the one or more SCU anchoring seals enabling the SCU to pass through the production tubing disposed in the wellbore of the well, and the deployed position of the one or more SCU anchoring seals providing a seal against a wall of the target zone of the open-holed portion of the wellbore to provide zonal isolation between regions in the wellbore; and one or more SCU centralizers configured to be positioned in an un-deployed position and a deployed position, the un-deployed position of the one or more SCU centralizers enabling the SCU to pass through the production tubing disposed in the wellbore of the well, and the deployed position of the one or more SCU centralizers positioning the SCU in the target zone of the open-holed portion of the wellbore, wherein the SCU comprises a plurality of SCU modules (SCUMs) configured to be advanced through the production tubing unassembled, and to be assembled to one another in the open-holed portion of the wellbore to form the SCU down-hole after the SCUMs are passed through the production tubing;

a down-hole wireless transceiver configured to be disposed at a down-hole end of the production tubing in the wellbore of the well, to be communicatively coupled to the surface control system of the well, to communicate wirelessly with the SCU wireless transceiver, and to provide for communication between the SCU wireless transceiver and the surface control system of the well; and a positioning device configured to provide a motive force to advance the SCU through the production tubing and the wellbore.

14. A method of completing a target zone of a wellbore of a well, the method comprising:

passing a sub-surface completion unit (SCU) through production tubing disposed in a wellbore of a well, wherein the SCU comprises a plurality of SCU modules (SCUMs) and the passing comprises:

passing the plurality of SCUMs through the production tubing unassembled to one another; and assembling the plurality of SCUMs to one another in the open-holed portion of the wellbore to form the SCU down-hole after the SCUMs are passed through the production tubing;

passing the SCU though the wellbore of the well to a target zone of an open-holed portion of the wellbore;

deploying one or more SCU centralizers of the SCU to position the SCU in the target zone of the open-hole portion of the wellbore; and deploying one or more SCU anchoring seals of the SCU to seal against a wall of the target zone of the open-hole portion of the wellbore to provide zonal isolation between regions in the wellbore.

15. The method of claim 14, wherein passing the SCU through the production tubing comprises passing the SCU through the production tubing in an un-deployed configuration comprising the one or more SCU centralizers and the one or more SCU anchoring seals in an un-deployed state having an outer diameter that is less than an inner diameter of the production tubing.

16. The method of claim 14, wherein the SCU comprises a plurality of SCU modules (SCUMs) assembled to one another, the method further comprising assembling the plurality of SCUMs to one another to form the SCU prior to the SCU being passed through the production tubing.

17. The method of claim 14, wherein the SCU comprises a SCU wireless transceiver configured to communicate with a surface control system of the well by way of wireless communication with a down-hole wireless transceiver, the method further comprising:

providing a down-hole wireless transceiver at a down-hole end of the production tubing in the wellbore of the well, the down-hole wireless transceiver communicatively coupled to a surface control system of the well, and configured communicate wirelessly with the SCU wireless transceiver, and to provide for communication between the SCU wireless transceiver and the surface control system of the well.

18. The method of claim 17, in response to the SCU wireless transceiver establishing communication with the surface control system of the well, the SCU wireless transceiver communicating directly with the surface control system of the well.

* * * * *